US010442562B2

(12) United States Patent
Gebbink et al.

(10) Patent No.: US 10,442,562 B2
(45) Date of Patent: Oct. 15, 2019

(54) SYSTEM AND METHOD OF DISCHARGING A TUBULAR STORAGE ASSEMBLY

(71) Applicant: Fuji Seal International, Inc., Osaka, Osaka-shi (JP)

(72) Inventors: Jeroen Gerrit Anton Gebbink, Helmond (NL); Stijn Antonius Petrus Verhoeven, Bakel (NL)

(73) Assignee: Fuji Seal International, Inc., Osaka-shi (JP)

( * ) Notice: Subject to any disclaimer, the term of this patent is extended or adjusted under 35 U.S.C. 154(b) by 0 days.

(21) Appl. No.: 15/753,779

(22) PCT Filed: May 27, 2016

(86) PCT No.: PCT/EP2016/062084
§ 371 (c)(1),
(2) Date: Feb. 20, 2018

(87) PCT Pub. No.: WO2017/032470
PCT Pub. Date: Mar. 2, 2017

(65) Prior Publication Data

US 2018/0251247 A1 Sep. 6, 2018

(30) Foreign Application Priority Data

Aug. 25, 2015 (NL) ..... 2015348

(51) Int. Cl.
*B65B 43/16* (2006.01)
*B65B 43/14* (2006.01)
(Continued)

(52) U.S. Cl.
CPC ..... *B65B 43/16* (2013.01); *B65B 3/045* (2013.01); *B65B 43/14* (2013.01); *B65B 43/20* (2013.01);
(Continued)

(58) Field of Classification Search
CPC ..... B65B 43/16; B65B 3/045; B65B 43/14; B65B 43/20; B65B 43/46; B65B 61/186; B65D 75/5861
(Continued)

(56) References Cited

U.S. PATENT DOCUMENTS 3,596,430 A * 8/1971 Parish ..... B65B 43/465 53/67
4,411,576 A * 10/1983 Smith ..... B23P 19/006 294/116
(Continued)

FOREIGN PATENT DOCUMENTS

JP 05170252 A 7/1993
WO WO-2012028980 A1 3/2012
(Continued)

OTHER PUBLICATIONS

"International Application No. PCT/CA2016/050249, International Search Report dated Jul. 19, 2016", (Jul. 19, 2016), 4 pgs.
(Continued)

*Primary Examiner* — Rakesh Kumar
(74) *Attorney, Agent, or Firm* — Schwegman Lundberg & Woessner, P.A.

(57) ABSTRACT

The application relates to a discharge system (1) for discharging a plurality of flexible containers from a tubular storage assembly, comprising: —a storage assembly support (12) configured to support the tubular storage assembly; —a discharge device (14) configured to remove the containers from the tubular storage assembly and move the containers one by one from the second end of the tubular storage assembly towards a discharge region (15), wherein the discharge device comprises: —a gripper unit (81); —a drive (82, 84) configured to cause the storage assembly and the gripper unit to rotate relative to each other; wherein the gripper unit is configured to grip dispensing spouts of
(Continued)

containers successively passing by the gripper unit, to transport the gripped dispensing spouts and associated containers in a substantially axial direction and to collect the dispensing spouts in the discharge region.

12 Claims, 13 Drawing Sheets

(51) Int. Cl.
*B65B 43/20* (2006.01)
*B65B 3/04* (2006.01)
*B65D 75/58* (2006.01)
*B65B 43/46* (2006.01)
*B65B 61/18* (2006.01)

(52) U.S. Cl.
CPC ..... *B65D 75/5861* (2013.01); *B65B 43/46* (2013.01); *B65B 61/186* (2013.01)

(58) Field of Classification Search
USPC ..... 221/210
See application file for complete search history.

(56) References Cited

U.S. PATENT DOCUMENTS 6,135,169 A * 10/2000 Sandei ..... G07F 13/065 141/129
6,378,691 B2 * 4/2002 Phelps ..... B65G 47/1471 198/456
6,490,782 B1 * 12/2002 Duckett ..... B01D 29/01 29/714
6,499,280 B1 * 12/2002 Tsutsui ..... B65B 43/52 141/169
6,575,289 B2 * 6/2003 Hiramoto ..... B65B 43/14 198/433
6,655,015 B2 * 12/2003 Kraenzle ..... A61C 17/005 29/783
6,938,753 B2 * 9/2005 Bonatti ..... B65G 47/847 198/470.1
7,007,443 B2 * 3/2006 Liedtke ..... B65B 15/04 53/399
7,121,428 B2 * 10/2006 Hiramoto ..... B31B 70/00 221/210
8,215,087 B2 * 7/2012 Malenke ..... B65B 5/101 53/148
8,490,662 B2 * 7/2013 Murray ..... B65B 43/42 141/165
9,233,820 B2 * 1/2016 Bernhard ..... B67B 3/2033
9,340,308 B2 * 5/2016 Nakagawa ..... B65B 43/42
9,340,309 B2 * 5/2016 Nakagawa ..... B65B 43/42
9,708,095 B2 * 7/2017 Rosselli ..... B65D 5/5052
9,725,193 B2 * 8/2017 Friedlein ..... B65B 3/02
9,950,822 B2 * 4/2018 Lukes ..... B65B 35/24
10,035,614 B2 * 7/2018 van der Meijden .... B65B 55/08
10,315,848 B2 * 6/2019 Gebbink ..... B65G 19/025
2002/0060136 A1 * 5/2002 Hiramoto ..... B65B 43/14 198/678.1
2009/0308023 A1 12/2009 Wada
2013/0269291 A1 * 10/2013 Harrison ..... B65B 5/108 53/236
2015/0314898 A1 * 11/2015 Schwarzli ..... G07F 11/44 53/411
2017/0283105 A1 * 10/2017 Tamarindo ..... A61L 2/081
2017/0311631 A1 * 11/2017 Murray ..... B65B 55/08
2017/0355478 A1 * 12/2017 Lukes ..... B65B 35/24
2018/0229875 A1 * 8/2018 Harth ..... B65B 31/042
2018/0244510 A1 * 8/2018 Harth ..... B65B 55/022
2018/0251247 A1 * 9/2018 Gebbink ..... B65B 3/045
2018/0346219 A1 * 12/2018 Murray ..... B65B 43/26

FOREIGN PATENT DOCUMENTS

WO WO-2014171814 A1 10/2014
WO WO-2014171834 A3 10/2014
WO WO-2015128427 A1 9/2015

OTHER PUBLICATIONS

"International Application No. PCT/CA2016/050249, Third Party Observation filed Mar. 23, 2017", (Mar. 23, 2017), 4 pgs.
"International Application No. PCT/CA2016/050249, Written Opinion dated Jul. 19, 2016", (Jul. 19, 2016), 6 pgs.

* cited by examiner

SYSTEM AND METHOD OF DISCHARGING A TUBULAR STORAGE ASSEMBLY

PRIORITY APPLICATIONS

This application is a U.S. National Stage Filing under 35 U.S.C. 371 from International Application No. PCT/EP2016/062084, filed on 27 May 2016, and published as WO2017/032470 on 2 Mar. 2017, which claims the benefit of priority to Netherlands Application No. 2015348, filed on 25 Aug. 2015; which applications and publication are incorporated herein by reference in their entirety.

The invention relates to a discharge system and a method for discharging a plurality of flexible containers from a tubular storage assembly, wherein each of the containers comprises a dispensing spout and wherein the storage assembly comprises a plurality of elongated guiding elements onto which a plurality of rows of dispensing spouts can be carried, wherein the guiding elements are configured to be maintained in a substantially tubular arrangement while the containers extend in a generally helical trajectory in the interior formed by the tubular arrangement.

Flexible containers for keeping fluid or dry products, such as a liquid, granular material, powder or the like, are known in the art. One example of a flexible container is a flexible container, for instance comprising a laminate composed of sheets of plastic or the like. For instance, a container may be made of a front and back wall comprising one or more flexible film, facing one another and joined, for example welded, along their edges. The container has an opening means to access the contents of the container. The opening means may be a spout sealed to the upper part of the flexible container, between the front and back wall. The opening can be sealed off, for instance by a removable screw cap, and may even provide for resealing the container after it has been opened. Examples of such flexible containers are described in US 2009 308023 A1.

Flexible containers may be manufactured at a location that differs from the location at which the containers are filled with products, for instance foodstuff. For instance, the containers may be manufactured at a first location, packed and then transported to a second location where they are unpacked. In order to transport the packed containers, they are loaded into a truck or other transport vehicle and at its destination (i.e. at the second location) the truck needs to be unloaded again. At the second location, for instance the location wherein the foodstuff is available, the unloaded and unpacked containers are filled with content and then transported further.

In order to transport the containers, they are arranged in elongated guiding elements or rails by sliding the spouts of the containers along the rail to form a row of containers. One or more of these rails provided with containers are packed, for instance using liners and carton boxes, and then transported by trucks to the second location. At the second location, the packaging material needs to be removed and the individual rails (guiding elements) each of which has a row of containers, is arranged in a filling machine which is configured to fill the individual containers.

This way of handling the containers has a number of disadvantages. First of all, the guiding elements (rails) with containers need to be packaged using packaging material like liner and cardboard boxes. This material needs to be removed again once the containers have arrived at the second location. This is labour extensive, requires a relatively large amount of packaging material and produces waste in the form of used packaging material. Furthermore, under specific circumstances, for instance when the spouts are to be handled in so-called clean rooms or clean environment, with a low level of environmental pollutants such as dust, airborne microbes, aerosol particles, and chemical vapours. Under these circumstances it is not always allowable to employ specific types of packaging materials, like cardboard or similar materials. Furthermore, the containers arranged in the guiding elements occupy a relatively large volume and therefore the cost for temporarily storing the packaged containers and transporting them are relatively high.

In order to address the above disadvantages a tubular storage assembly has been developed wherein the spouted containers can be stored. The spouted containers are loaded in a number of elongated guiding elements that are maintained in a substantially tubular arrangement. The containers are stored in the interior of this tubular arrangement and the guiding elements protect the containers from external influences.

While the tubular storage assembly thus created enables an easy storage and/or transport of the containers, the loading (charging) of the storage assembly and the unloading (discharging) thereof is still a complex and time consuming operation. The containers need to be loaded into and unloaded from the storage assembly one by one. Furthermore the containers are loaded in such a manner that they extend along a generally helical trajectory inside the interior storage space of the tubular storage assembly. Similarly, unloading the spouted containers from the storage assembly requires removing the containers one by one from the respective guiding elements and when unloading the containers the order in which the containers have been loaded into the guiding elements needs to be followed again.

It is an object to provide a system and method for discharging containers from such tubular storage assembly. It is also an object to provide a system and method for discharging containers in a fast, reliable and/or efficient manner from one or more tubular storage assemblies. It is a further object to provide a discharge system and method for discharging a plurality of flexible containers from a tubular storage assembly that enable a fully automatic unloading of the containers.

According to a first aspect at least one of the objects and/or other objects is at least partially achieved in a discharge system as defined in the preamble, the discharge system comprising:

- a storage assembly support configured to support the tubular storage assembly, the guiding elements extending in axial direction;
- a discharge device arranged configured to remove the containers from the tubular storage assembly and move the containers one by one from the second end of the tubular storage assembly towards a discharge region, wherein the discharge device comprises a gripper unit and a drive configured to cause the storage assembly and the gripper unit to rotate relative to each other, wherein the gripper unit is configured to grip dispensing spouts of containers successively passing by the gripper unit, to transport the gripped dispensing spouts and associated containers in essentially the axial direction and to collect the dispensing spouts in the discharge region.

The tubular storage assembly may take an essentially cylindrical shape, for instance with a constant or varying circular, oval or polygonal cross-section. Furthermore the tubular storage assembly has at least one open end (for instance, a first end and a second end, opposite the first end).

At the open end(s) the containers are accessible by the discharge device so that the containers may be removed from the tubular storage assembly. When the gripper unit of the discharge device is arranged to face an open end it may be able to grip the containers one at a time and in the order in which the containers have been positioned (i.e. in a helical pattern, during loading of the assembly) so that the containers may be removed from the tubular storage assembly in a fast and efficient manner.

In some embodiments the storage assembly support is configured to support the tubular storage assembly in a stationary position. The drive may be configured to rotate the gripper unit relative to the (stationary) tubular storage assembly. This has the advantage that the relatively heavy tubular storage assembly (in loaded condition the mass of the storage assembly may be as high as 10 kg or more) does not need to be accelerated or decelerated at the start and end of the discharge operation. However, in other embodiments the gripper unit is stationary and the drive is configured to rotate the tubular storage assembly relative to the gripper unit. In still further embodiments both the tubular storage assembly and the gripper unit are rotated.

In embodiments with a rotatable drive gripper unit the unit may comprise:

- a rotatable gripper support configured to rotate about an axis of rotation parallel to or coinciding with the axis of symmetry of the tubular storage assembly;
- a slotted gripper configured to engage successive dispensing spouts of containers when the slotted grippers is rotated to pass by the containers carried by successive guiding elements and to guide the engaged dispensing spouts one by one through the slot provided therein towards the discharge region.

The gripper unit, more specifically the gripper thereof, is arranged to face an open end of the tubular storage assembly, from which open end the containers are directly accessible. The gripper may comprise a hook member to guide the spouts of the containers in the slot in the slotted gripper. The hook member may be attached to the gripper in such a manner that it is positioned in a radially inward position relative to the containers in the tubular storage assembly so that the hook member can engage the container at a lower portion of the spout (for instance a portion below its lowest side flange, as will be explained later).

In other embodiments the hook member is positioned to engage the container at an upper portion of the spout. In order to create space at the upper portion of the spout to allow engaging by the hook member (which space is not always available due to the specific shape of the guiding elements from which the containers suspend), an intermediate tubular unit may be placed between the gripper unit and the open end of the tubular storage assembly. The intermediate tubular unit comprises a plurality of further elongated guiding elements onto which a plurality of rows of dispensing spouts can be carried, wherein the further guiding elements are configured to be maintained in a substantially tubular arrangement corresponding to guiding elements of the tubular storage assembly.

The intermediate tubular unit may be shaped so that the gripper unit can grip a dispensing spout at a radially outer position relative to the tubular arrangement of further guiding elements, preferably also at a radially inner position.

The further elongated guiding elements are connected to one or more support rings, herein also referred to as support bridges. These support rings maintain the further guiding element in a tubular arrangement while providing the gripper unit (for instance the hook member) access to the upper portions of the containers carried by the guiding elements of the tubular storage assembly.

In order to help releasing a container from neighboring containers in the tubular storage assembly the slot of the slotted gripper may be shaped so as to control rotation of the dispensing spout and associated container relative to the gripper. For instance, the slot may be shaped so as to force rotation of the dispensing spout and associated container in a first rotational direction to arrange the container from a first position extending essentially perpendicular to the axial direction to a second position extending obliquely relative to the axial direction and subsequently force the dispensing spout and associated container to rotate in a second direction, opposite the first direction. Practice has shown the dispensing spout and associated container has a preference to turn into one direction, while being taken by the gripper unit and releasing from neighboring containers. This turning is not preferred to happen, since it is leading to wrong orientation of the dispensing spout and associated container for further guidance. Since this turning cannot be prohibited, it seems preferable to reverse-turn the dispensing spout and associated container in order to compensate for this. This gives a more reliable, stable process to further guide the dispensing spout and associated container, in a controlled manner.

In specific embodiments the slot of the slotted gripper comprises:

- a proximal slot portion extending obliquely relative to the axial direction of the tubular storage assembly causing the dispensing to rotate in the first rotational direction;
- an intermediate slot portion comprising an edge part configured to rotate the dispensing spout in opposite rotational direction;
- a distal slot portion for accumulating a plurality of dispensing spouts and guiding the dispensing spouts towards the discharge region.

The discharge device further comprise a discharge unit configured to move the containers in the slot of the slotted gripper from the discharge device, for instance to an outfeed lane of similar device for further handling of the containers. In an embodiment the discharge unit comprises a sweeper arm. The sweeper arm is configured to sweep the collected dispensing spouts out of the gripper unit, for instance when the rotation of the gripper unit and/or the tubular storage assembly is temporarily halted.

As mentioned above, the discharge device comprises a drive configured to rotate the gripper unit relative to the tubular storage assembly. The drive may comprise a drive shaft connected to the rotatable gripper support, the drive shaft being arranged essentially coaxially with the tubular storage assembly. In this embodiment it may be advantageous to provide the gripper with an essentially curved shape so as to allow the gripper to be rotated in a trajectory around the drive shaft. This provides a compact construction of the discharge device.

The storage assembly support may comprise one or more positioning arms configured to be moved between an open position wherein the tubular storage assembly can be removed or loaded and a closed position wherein the positioning arms form an essentially annular gripping space. Preferably the diameter of the gripping space is smaller than the outer diameter of the tubular storage assembly, so that an accurate and reliable positioning of the guiding elements of the tubular storage assembly is secured.

In certain embodiments the storage assembly support is configured to support the tubular storage assembly in a substantially upright position. For instance, the tubular storage assembly may be supported to extend in an upright position (vertical position or oblique position) so as to cause the containers to move due to the gravitational force in an axial, downward direction towards the discharge device. No further mechanical means are needed to provide this movement, although the movement of the containers may be assisted by a pusher and/or a vibration unit, as will be explained hereafter.

In other embodiments the storage assembly support is configured to support the tubular storage assembly in a substantially lying position. For instance, the tubular storage assembly may be supported to extend in a horizontal position). In order to ensure movement of the containers towards an open end of the tubular storage assembly in these embodiments (or to assist the movement of the containers in the earlier mentioned embodiments wherein the tubular storage assembly is arranged in an upright position), the discharge system may comprise a pusher. The pusher may be configured to engage one or more containers arranged at a first end of the tubular storage assembly and configured to push the containers arranged in the tubular storage assembly in axial direction towards a second end, opposite the first end. The storage assembly support may be configured to support the tubular storage assembly in an essentially horizontal orientation. In this case the pusher is needed to push the containers out of the storage assembly. In other embodiments the storage assembly support may be configured to support the tubular storage assembly in an essentially upright (for instance, a vertical or oblique) orientation. Also in this case a pusher may be provided to push the containers out of the bottom end (or even the upper end) of the storage assembly. However, in some cases a pusher can be dispensed with and the containers may be moved to towards the discharge device under the influence of gravity.

In order to further ensure a proper positioning of the tubular storage assembly (with or without the intermediate tubular unit) relative to the discharge device the pusher may further be configured to engage the first end of the tubular storage assembly so as to position the second end of the tubular storage assembly relative to the gripper unit. In an embodiment the pusher comprises a support ring having axial projections configured to be coupled to the individual guiding elements so as to position the guiding elements relative to each other. An advantage is to keep the individual guiding elements in (tubular) position once the containers are moving out of the arrangement. In case the ring with its axial projection would not be present, the tubular arrangement/the guiding elements would collapse. Furthermore, the pusher may be configured to bias the dispensing spouts of the containers at the second end of the tubular storage assembly against the gripper unit.

In an embodiment the pusher comprises a pusher element configured to engage the containers at axially staggered positions along a helical trajectory. In this manner each of the containers engaged by the pusher is exposed to the same pushing force. This even distribution of pushing forces has a positive effect on the manner the containers are moved towards the discharge end of the tubular storage assembly.

Preferably the pusher is configured to engage the one or more containers at their respective dispensing spouts. The containers can be moved more smoothly because of a pushing force that can be aligned more easily with the longitudinal direction of the guiding elements.

Optionally the discharge system comprises a vibration section configured to vibrate the tubular storage assembly when the tubular storage assembly is on the tubular storage assembly support. This vibration section is especially (but not exclusively) suitable for assisting the containers to be discharged from the bottom of the storage assembly when the assembly is supported in an upright position.

According to another aspect a method of discharging a plurality of flexible containers from a tubular storage assembly is provided. The method comprises:

- arranging the tubular storage assembly on a support while keeping one end of the tubular storage assembly at short distance to the gripper unit;
- moving the containers arranged in the tubular storage assembly in axial direction towards the discharge device;
- rotating the tubular storage assembly and/or the gripper unit relative to each other;
- gripping dispensing spouts of containers successively passing by the gripper unit;
- transporting the gripped dispensing spouts and associated containers in a substantially axial direction;
- collecting the dispensing spouts in the discharge region.

The above mentioned short distance may be in the range between 1 mm and 10 mm, but a smaller or larger distance is also possible.

The method may comprise supporting the tubular storage assembly in a stationary position and/or rotating the gripper unit relative to the tubular storage assembly.

The method may further comprise:

- rotating a rotatable gripper support about an axis of rotation parallel to or coinciding with the axis of symmetry of the tubular storage assembly;
- engaging by a slotted gripper successive dispensing spouts of containers when the slotted grippers is rotated to pass by the containers carried by successive guiding elements;
- guiding the engaged dispensing spouts one by one through the slot provided therein towards the discharge region.

In embodiments of the present method the dispensing spouts may be guided through a slot in the slotted gripper thereby controlling rotation of the dispensing spout and associated container. More generally, the method may comprise:

rotating the dispensing spout and associated container in a first rotational direction to arrange the container from a first position extending essentially perpendicular to the axial direction to a second position extending obliquely relative to the axial direction; and subsequently rotating the dispensing spout and associated container in a second direction, opposite the first direction.

The method may involve intermittently rotating the tubular storage assembly and/or the gripper unit relative to each other. This means that the rotation is periodically halted, for instance to allow the collected spouts (containers) to be removed, for instance by sweeping the spouts out of the slot of the slotted gripper.

In order to properly align the guiding elements of the tubular storage assembly relative to the discharge device, the method may comprise:

moving the one or more positioning arms between an open position wherein a the tubular storage assembly can be removed or loaded and a closed position wherein the positioning arms form an essentially annular gripping space, wherein the diameter of the gripping space is smaller than the outer diameter of the tubular storage assembly.

To help the containers to be moved in the direction of the discharge end the tubular storage assembly may be vibrated temporarily. Alternatively or additionally the method may comprise actively pushing the containers towards the discharge end. Furthermore, the method may also involve engaging (for instance pushing) the first end of the tubular storage assembly so as to position the second end of the tubular storage assembly relative to the gripper unit.

In order to prevent the tubular storage device from collapsing, especially when the containers are pushed towards the discharge end, the method may comprise coupling a support ring having axial projections to individual guiding elements so as to position the guiding elements relative to each other. The coupling ring prevents the tubular storage assembly from collapsing.

Furthermore, the method may comprise pushing the containers in such a way that each container receives essentially the same pushing force. This may be accomplished by engaging the spouts of the containers at axially different positions. Other ways of providing a similar pushing force on each of the containers at the proximal end of the tubular storage assembly also fall within the scope of the present teaching.

Further characteristics of the present invention will be elucidated in the accompanying description of various preferred embodiments thereof. In the description reference is made to the annexed figures.

In the following description, for the purposes of explanation, numerous specific details are set forth in order to provide a thorough understanding of the present invention. It will be apparent, however, that the present invention may be practiced without these specific details. In other instances, well-known structures and devices are not described in exhaustive detail, in order to avoid unnecessarily obscuring the present invention.

As will be apparent to those of skill in the art upon reading this disclosure, each of the individual embodiments described and illustrated herein has discrete components and features which may be readily separated from or combined with the features of any of the other several embodiments without departing from the scope of the present invention. Any recited method can be carried out in the order of events recited or in any other order which is logically possible It is noted that, as used herein and in the appended claims, the singular forms "a", "an", and "the" include plural referents unless the context clearly dictates otherwise. It is further noted that the claims may be drafted to exclude any optional element. As such, this statement is intended to serve as antecedent basis for use of such exclusive terminology as "solely," "only" and the like in connection with the recitation of claim elements, or use of a "negative" limitation.

Tubular Storage Assembly

As herein the tubular storage assembly is an assembly of guiding elements placed in such arrangement that they define the shape of a tube. Herein the tubular storage assembly may therefore also be denoted by the term "tubular arrangement". Each of the guiding elements of the tubular storage assembly is configured to allow guiding of one or more containers so that the containers may be stored inside the interior formed by the combination of guiding elements. Several examples of a tubular storage assembly are described hereafter that may be unloaded by embodiments of the present discharge system.

Figure 2:
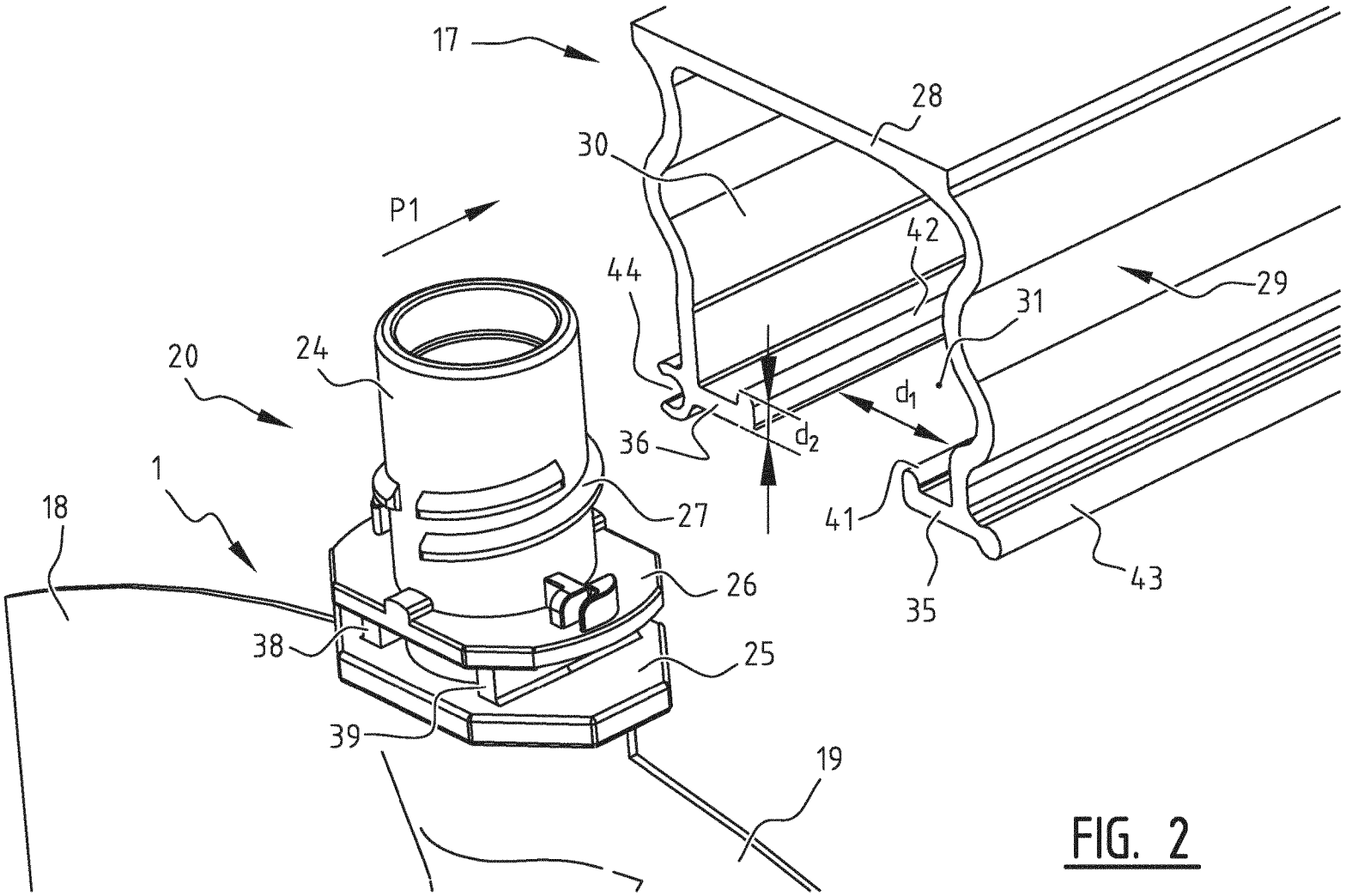
FIG. 2 shows a spouted container (also referred to as spouted pouch) and one of the guiding elements of an embodiment of a tubular storage assembly (also referred to as the tubular arrangement)
Figure 3:
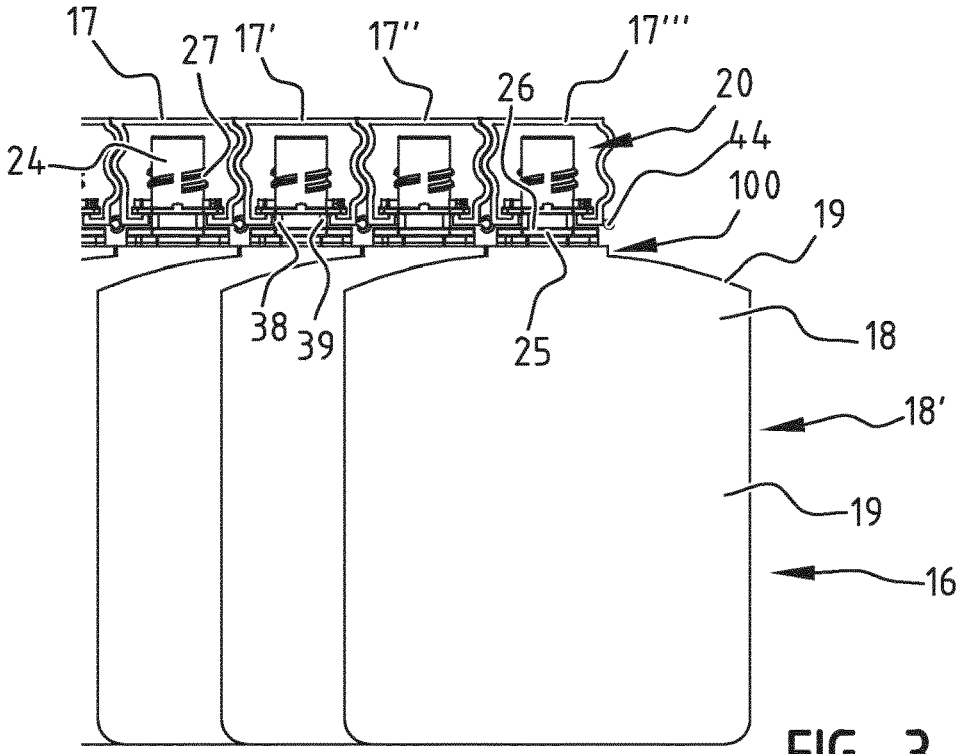
FIG. 3 shows a couple of spouted containers arranged in respective interconnected guiding elements.

FIGS. 2 and 3 show an example of a pouch container 16 (herein also referred to as a container or a pouch), comprising a front wall 18 and a back wall 18', both walls being made of thin, flexible film material, preferably plastic film material. The walls 18, 18' are sealed along their circumferential edges 19 to form a package for flowable products, for example foodstuff, cosmetics, medicines, etc. In the upper edge of the container 16 a dispensing element, herein also referred to as a (dispensing) spout 20, is arranged. The spout 20 of the container 16 comprises an elongated dispensing tube 24. The upper end of the dispensing tube 24 is provided with thread windings 27 for attaching a removable end cap (not shown) on the container 16 after it has been filled. The lower end of the dispensing tube 24 extends through the upper circumferential edge 19 and extends into the interior thereof so that the dispensing tube 24 may provide a fluid connection between the interior of the container 16 and its surroundings so that the content of the container 16 may be dispensed when the end cap is removed. The dispensing tube 24 is provided with two lateral elements which serve to attach the container 16 to a guiding element 17. More specifically, the dispensing tube 24 comprises an upper flange part 26 and a lower flange part 25.

Guiding rail or guiding element 17 is an elongated section comprising an upper section part 28, a first section side part 29 and a second section side part 30, both section side parts 29, 30 extending roughly orthogonally with respect to the upper section part 28. At the free ends of the section side parts 29,30 a slotted carrier part for carrying the spout 20 of a spouted container 16 is provided. The carrier part comprises inwardly extending section flanges 35,36 forming a slot between the free ends of the flanges. The distance ($d_1$) between the section flange 35 of the first section side part 29 and section flange 36 of the second section side part 30 is slightly larger than the distance between upright walls 38,39 of the spout 20 and smaller than the width of the upper flange part 26 and lower flange part 25 of the spout 20. Furthermore the section flanges 35,36 are provided at their respective outer ends with longitudinal ridges 41,42 along which the upper flange part 26 of the dispensing element (spout 20) of the container 16 can be slid. The distance between the upper flange part 26 and the lower flange part 25 of the spout 20, i.e. the width of the channel 31 defined in the guiding element 17, is slightly larger than the distance $d_2$ between the top and bottom of a longitudinal ridge 41,42 and such that the longitudinal ridges 41,42 are properly maintained between the upper flange part 26 and lower flange part 25. Therefore the container 16 can be moved easily into the guiding element 17 by sliding the spout 20 smoothly (in direction $P_1$) to be stably maintained within the guiding element 17 by the both flange parts 25,26 of the spout 20 and the section flanges 35,36 of the guiding element 17. The number of containers 16 that can be arranged in the guiding element 17 depends amongst others on the length of the guiding element 17 and the dimensions of the respective spouts 20 of the containers 10. As a not limiting example a typical guiding element may carry between 50 and 60 containers.

Referring to FIG. 2 the first section side part 29 of the guiding element 17 comprises an outwardly extending flange forming a male coupling element 43. Similarly the opposite section side part 30 of the guiding element 17 comprises a female coupling element 44. The male and female coupling elements 43,44 extend along at least a substantial part of the length of the guiding element 17 and are dimensioned in such a way that the male coupling element 43 of a first guiding element 17 can be inserted into the female coupling element 44 of a second guiding element 17' to mutually couple the guiding elements. The coupling elements 43,44 are configured to connect two or more parallel guiding elements 17",17'" while still allowing the guiding elements to pivot relative to one another, for instance between the flat arrangement of FIG. 3 to the curved (more specifically, tubular) arrangement of FIGS. 4 and 5.

Figure 4:
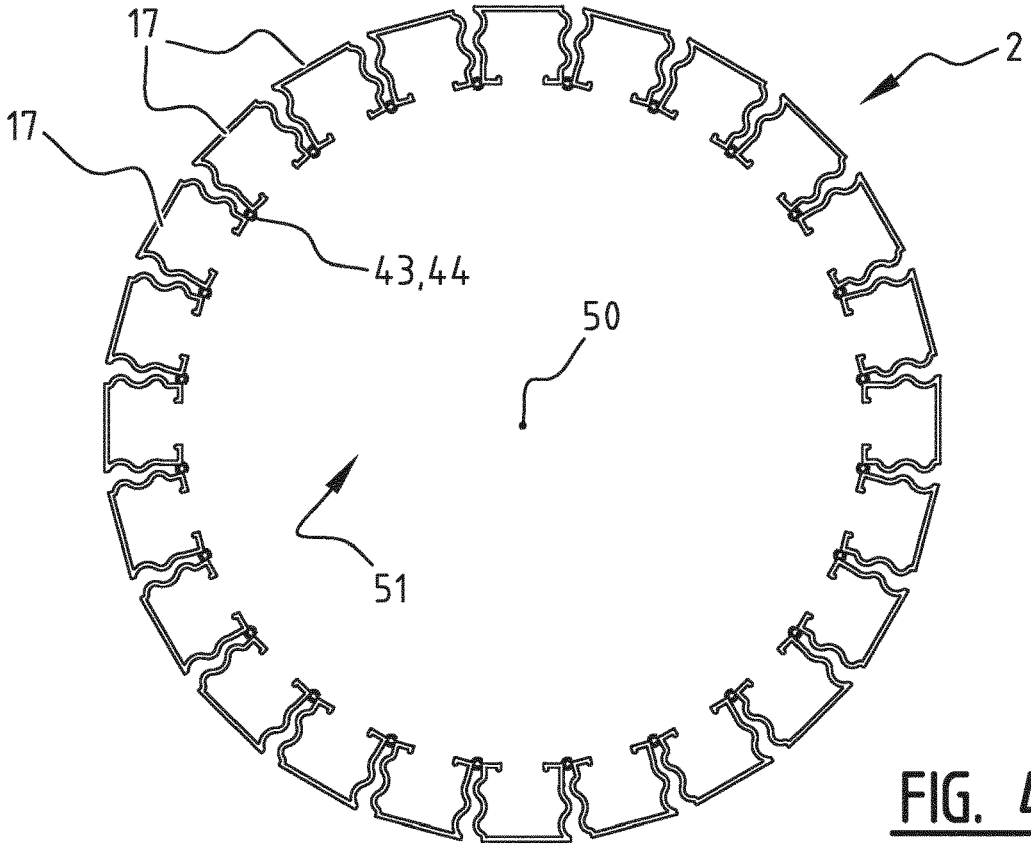
FIG. 4 is a cross section of the tubular storage assembly of the previous figures.
Figure 5:
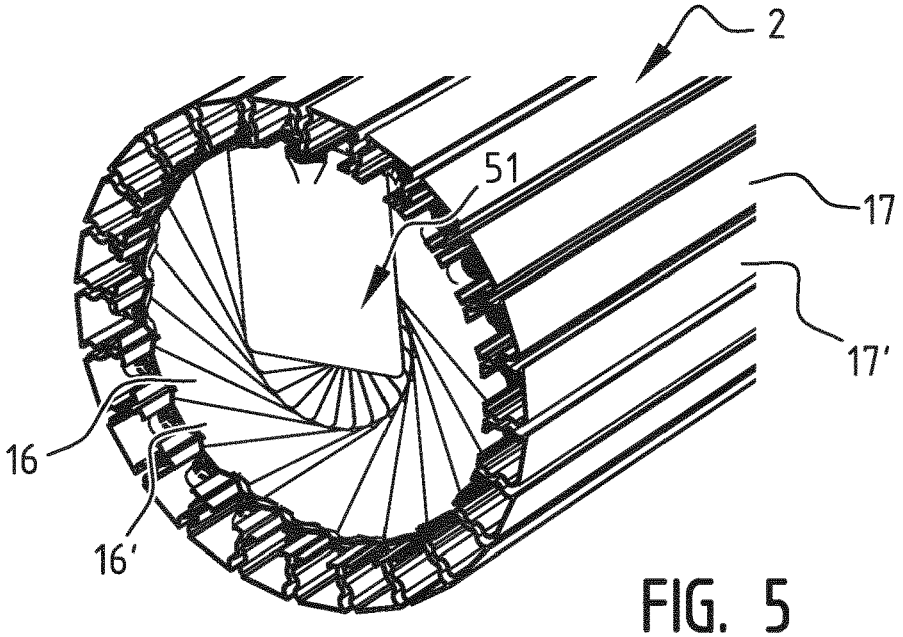
FIG. 5 is a partly cut-away front view of the tubular storage assembly of FIG. 4.

The guiding elements 17 arranged in the tubular arrangement of FIGS. 4 and 5 are self-maintaining (or self-supporting) so that the guiding elements 17 can be coupled in such a manner, that they are mutually supported and that they remain in their tubular arrangement without needing any further means. In other embodiments the guiding elements 17 need to have a support element, for instance a sleeve or a tube, to maintain the guiding elements 17 in their tubular arrangement.

Referring to FIG. 5 a tubular storage assembly 2 completely filled with a large number of containers 16 is shown. The figure shows that the spouted containers 16 have been inserted into the tube-like arrangement in such a manner that they extend in a generally helical trajectory along the length of the guiding elements 17. In other words, in order to optimize the use of the space available in the interior 51 of the tubular storage assembly 2, the containers 16 may be arranged in the tubular arrangement in angularly displaced positions. This helical trajectory may have been accomplished by inserting the spout 20 of a first container 16 in a first guiding element 17, then arranging a second container in a partly overlapping manner in the tube-like arrangement by inserting the associated spout into a second guiding element 17' (as a non-limiting example, by inserting the spout into the neighbouring guiding element) and repeating the same until the entire interior of the tubular arrangement is filled with containers 16.

The number of guiding elements of the tubular arrangement may vary. Generally the number of guiding elements is n, wherein n=1, 2, 3, 4 . . . . Furthermore, not all guiding elements need to be filled with containers. In embodiments of the invention only a subset of the guiding elements is selectively filled, for instance six or twelve of a total number of 24 guiding elements, depending on the shape and/or size of the containers, for instance with a view to provide for a compact storage.

In a typical (but non-limiting) example 24 containers per rotation (revolution) can be accommodated in the tubular arrangement. Depending on the length of the guiding elements and the dimensions of the containers about 53 rotations can be accommodated in the tubular arrangement. This means that the storage capacity of one tubular storage assembly can be as high as 1272 containers.

Storage Assembly Support

Figure 1A:
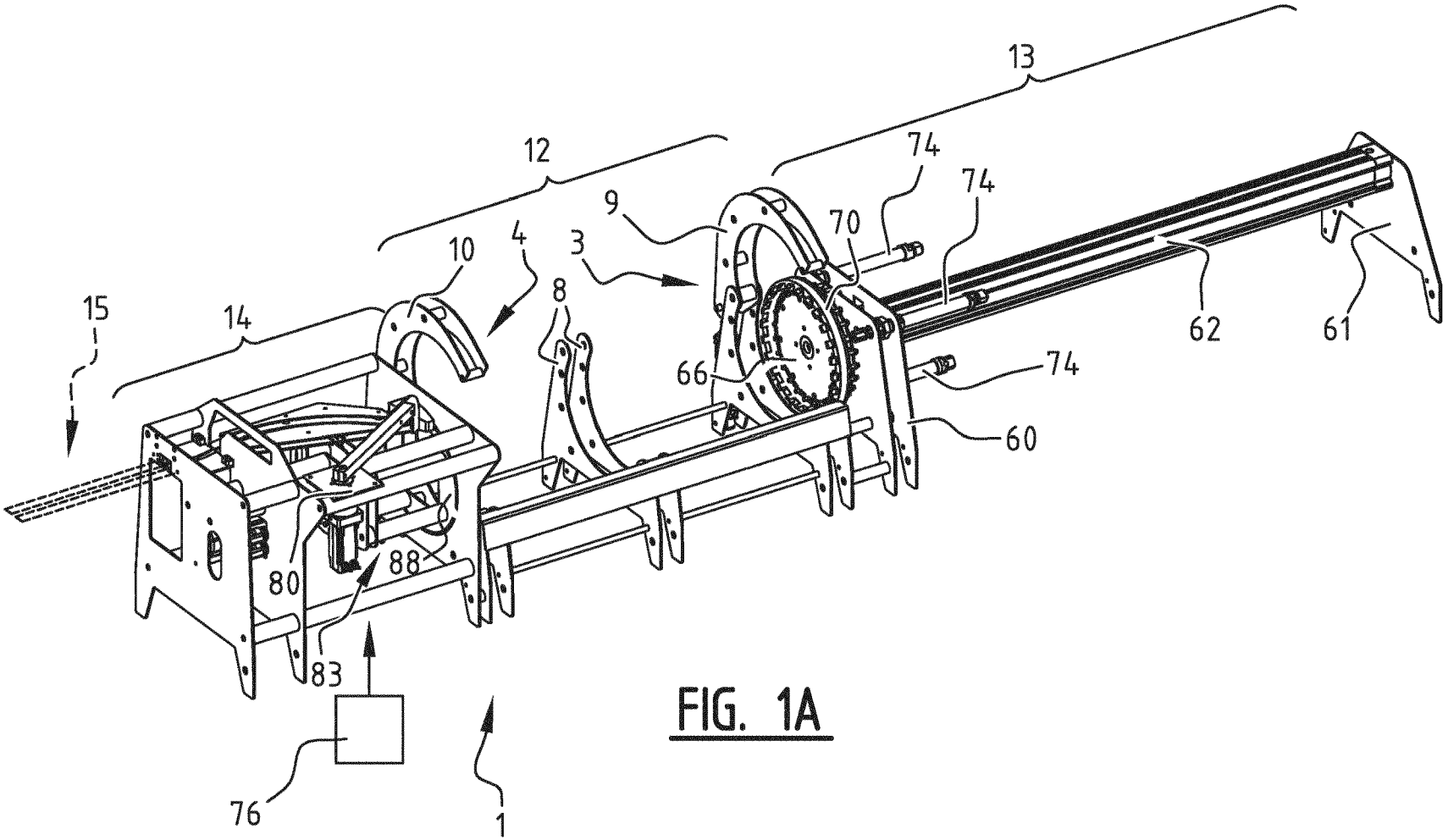
FIGS. 1A and 1B are schematic side views of a first embodiment of the discharge system, without a tubular storage assembly and with a loaded tubular storage assembly, respectively.
Figure 1B:
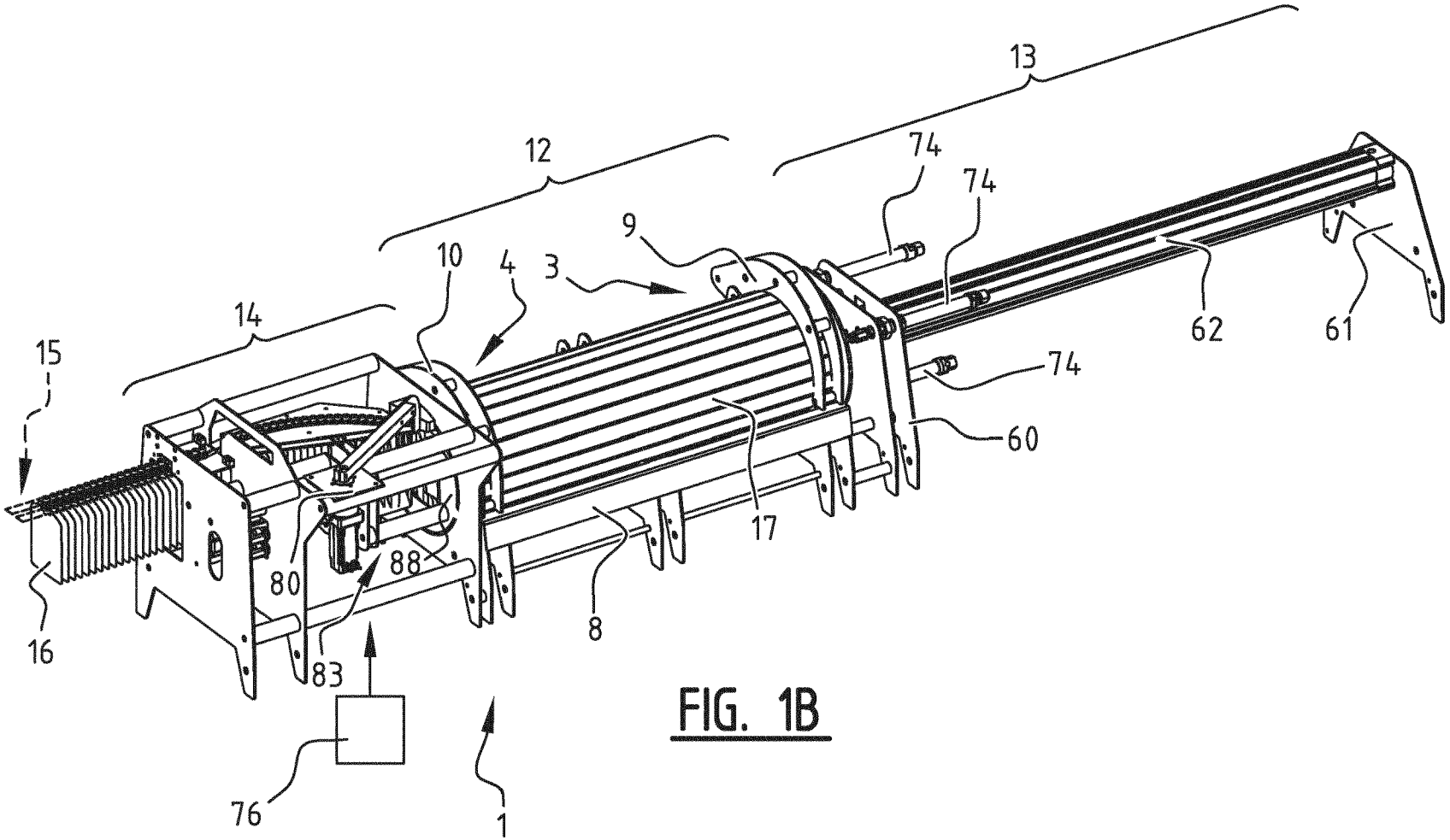

FIGS. 1A and 1B show an embodiment of a discharge system 1 for discharging a plurality of flexible containers (for instance pouches) that have been arranged in a tubular storage assembly 2. FIG. 1A shows the discharge system without the tubular storage assembly 2, i.e. before the discharge system is loaded with a tubular storage assembly 2. The discharge system 1 comprises a storage assembly support 12, a discharge device 14 and, optionally, a pusher 13.

In case the storage assembly 2 comprises a number of guiding elements 17 made of more or less flexible material, the individual guiding elements 17 may be slightly movable relative to each other so that an accurate positioning of the guiding elements 17 with respect to the discharge device 14 is difficult to achieve. However, it is important to provide an accurate positioning of the guiding elements 17 and therefore an accurate alignment of the guiding elements 17 with respect to the discharge device 14 in order to guarantee a reliable and fast operation of the discharge device 14.

In order to solve this issue the storage assembly support 12 of the discharge system 1 comprises a stationary support frame 8 having curved sections on which a tubular storage assembly 2 can be placed. The storage assembly support 12 also comprises two movable positioning arms 9 and 10. These arms 9, 10 are curved (for instance, semi-circular) and can be pivoted between an open position as shown in FIG. 1A and a closed position as shown in FIG. 1B. In the closed position the movable positioning arms 9, 10 together with the curved sections of the stationary support frame 8 form a clamp for firmly holding the tubular storage assembly 2. More specifically, in the open position of the position arms 9, 10 the arms provide space for the tubular storage assembly 2 to be placed upon the support frame 8. Once the tubular storage assembly 2 has been arranged on the support frame 8, the position arms 9, 10 can be pivoted towards the closed position. In the closed position the positioning arms 9, 10, together with the stationary support frame 8 form an essentially annular construction enclosing an essentially cylindrical space. The curved positioning arms 9, 10 and the curved parts of the support frame 8 may cooperate to force the tubular storage assembly 2 into the desired cylindrical shape. In some embodiments the diameter of the annular construction is chosen to be somewhat smaller (for instance, about 3-10%) than the original outer diameter of the tubular storage assembly 2 itself. The result is that the tubular storage assembly 2 is clamped in the support frame 8 in the desired, correct cylindrical shape and that the discharge ends of the guiding elements 17 are accurately positioned relative to the (gripper of) the discharge device 14.

In FIGS. 1A, 1B is further shown that close to a first (proximal) end 3 of the tubular storage assembly 2 a (optional) pusher 13 is arranged. This pusher 13 serves on one hand to push the containers 16 previously stored inside the tubular storage assembly 2 along the guiding elements 17 towards the second (distal or discharge) end 4, opposite the first end 3, in the direction of the discharge device 14 and on the other hand to keep the guiding elements 17 in proper alignment with the discharge device 14. In other embodiments an alternative mechanism may be provided for moving the containers 16 inside the tubular storage assembly 2 towards the discharge opening. For instance, in the embodiment shown in FIG. 16 wherein the tubular storage assembly 2 is arranged in a substantially upright position, the containers 16 inside the assembly 2 may be moved in downward direction under the influence of the force of gravity towards the discharge device 14. In such embodiment a pusher 13 can be dispensed with or be replaced with a different type of mechanism such as a vibration unit, as will be explained hereafter.

Referring to FIGS. 1A, 1B, the discharge device 14 is positioned at the discharge end 4 of the tubular storage assembly 2. The discharge device 14 is configured to remove the container 16 from the tubular storage assembly 2 and move the containers 16 one by one from this second, discharge end 4 of the tubular storage assembly 2 towards a discharge region of the discharge device 14 where the containers 16 are collected for further transport. The discharge device 14 can be connected or associated with any output device, for instance an outfeed lane 15, for further transport of the containers 16, for instance in the direction of one or more handling stations. In the figures outfeed lane 15 has been schematically shown in dotted lines in order to make clear that in fact any type of output device can be used to discharge the containers 16 from the discharge region of the discharge device 14.

Pusher

Referring to FIGS. 1A, 1B, 6 and 7 an embodiment of the pusher 13 is described in more detail. Pusher 13 is configured to engage one or more of the container rows positioned at the first end 3 of the tubular storage assembly 2 and to push these containers axially in the direction of the discharge end 4 of the tubular storage assembly 2. By moving the containers in axial direction (cf. direction $P_p$ in FIGS. 6 and 7) towards the distal, discharge end 4, the containers located at the discharge end 4 may be taken out of the tubular storage assembly 2 and fed to the outfeed lane 15.

To this end the pusher 13 may comprise a frame consisting of at least a first frame part 60 and a second frame part 61. A linear actuator 62 is connected between these frame parts 60, 61. This linear actuator 62 is configured to push a rod 63 in axial direction (direction $P_p$). At the distal end of this rod 63 a container pusher element 64 is arranged. The container pusher element 64 is comprised of a generally cylindrical block at the circumference thereof a number of pins 65 are mounted. Pins 65 extend in a generally axial direction and function to engage respective containers (more specifically, the spouts of these containers) in the tubular storage assembly 2 through the interior space 51 (cf. FIG. 5) thereof.

Figure 6:
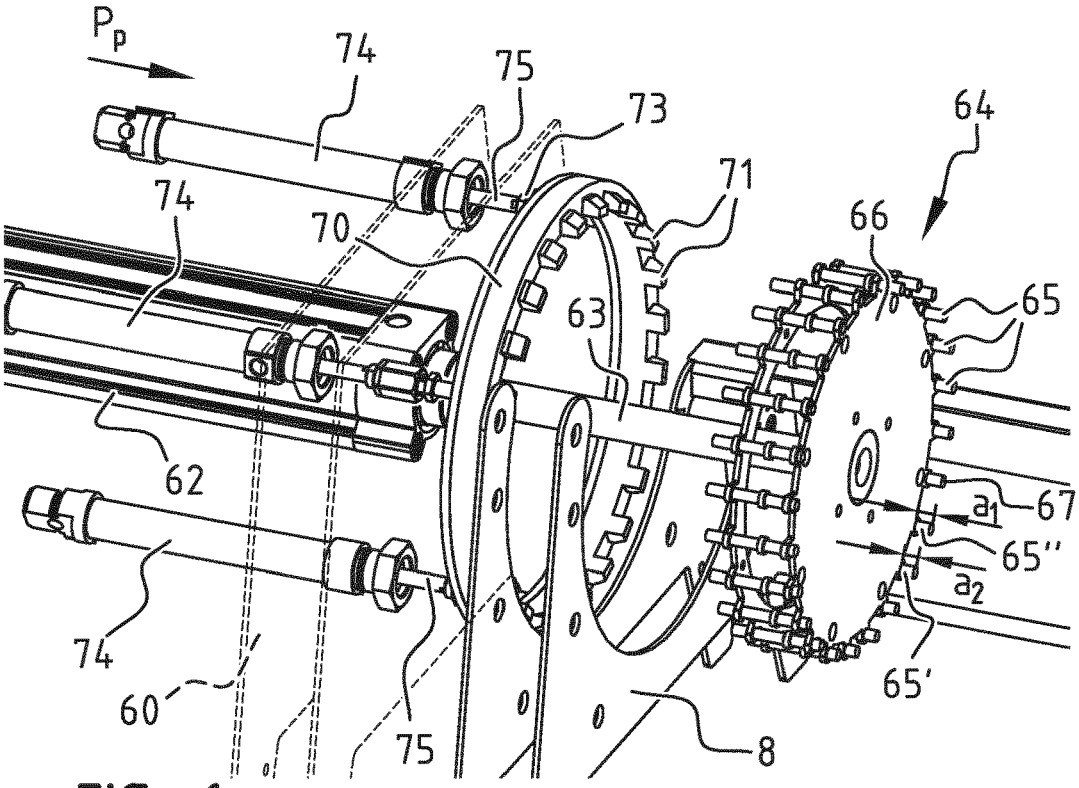
FIG. 6 is a partly cut-away view of an embodiment of a pusher for pushing containers towards a discharge device and a part of the support for a tubular storage assembly.

As shown in FIG. 6, pins 65 are arranged at equidistant positions along the outer circumference of the block. Furthermore they are mounted in such a manner that each extends at different length relative to the front surface 66 of the block of the container pusher element 64. For instance, FIG. 6 shows a first pin 65' and a second pin 65". The projection length ($a_2$) over which the first pin 65' projects from the front surface 66 of the block is smaller than the projection length ($a_1$) the second pin 65" extends from the same surface 66. The pins 65 are projecting from the front surface 66 at such projection lengths that their respective end surfaces 67 in an evenly distributed manner engage the (spouts of) the containers 16 that have previously been stored in a helical pattern in the guiding elements 17 of the tubular storage assembly 2. In other words, the projection lengths of the respective pins 65 are such that they can follow the helical trajectory of the spouts inside the tubular storage assembly 2 so that each container is pushed with essentially the same pushing force towards the discharge end 4. In this manner the risk of any container getting stuck during its displacement through the interior of the tubular storage assembly 2 is reduced.

Optionally, the pusher 13 may be configured to engage the proximal end 3 of the tubular storage assembly 2, for instance the end faces of the guiding elements 17, in order to position the tubular storage assembly 2 in an accurate manner with respect to the discharge device 14.

To this end a number of linear actuators 74 is provided. In the shown embodiment three linear actuators 74 have been provided, in other embodiments this number may be lower or higher. Each of the linear actuators 74 is connected to the frame part 60. Each linear actuator 74 is provided with a movable rod 75 that can be moved in axial direction (direction $P_p$) through a corresponding opening in the frame part so that its end part 73 can push against the circumferential edge of a support ring 70 connected to the outer ends of the guiding elements 17. Support ring 70 is shown in more detail in FIGS. 6 and 7. The support ring 70 is provided with a number of axial projections or teeth 71. The teeth 71 are configured to be coupled to the individual guiding elements 17 of the tubular storage assembly 2. More specifically, the teeth 71 are shaped so as to snugly fit within the space between the first and second section side parts 29, 30 of a guiding element 17. The rod 75 of the linear actuator 74 engaging upon the proximal side of the support ring 70 ensures a correct positioning of the guiding elements 17 of the tubular storage assembly 2 (i.e. correct positioning not only of the proximal end 3 but also of the distal end 4 facing the discharge device 14).

Discharge Device

Figure 8:
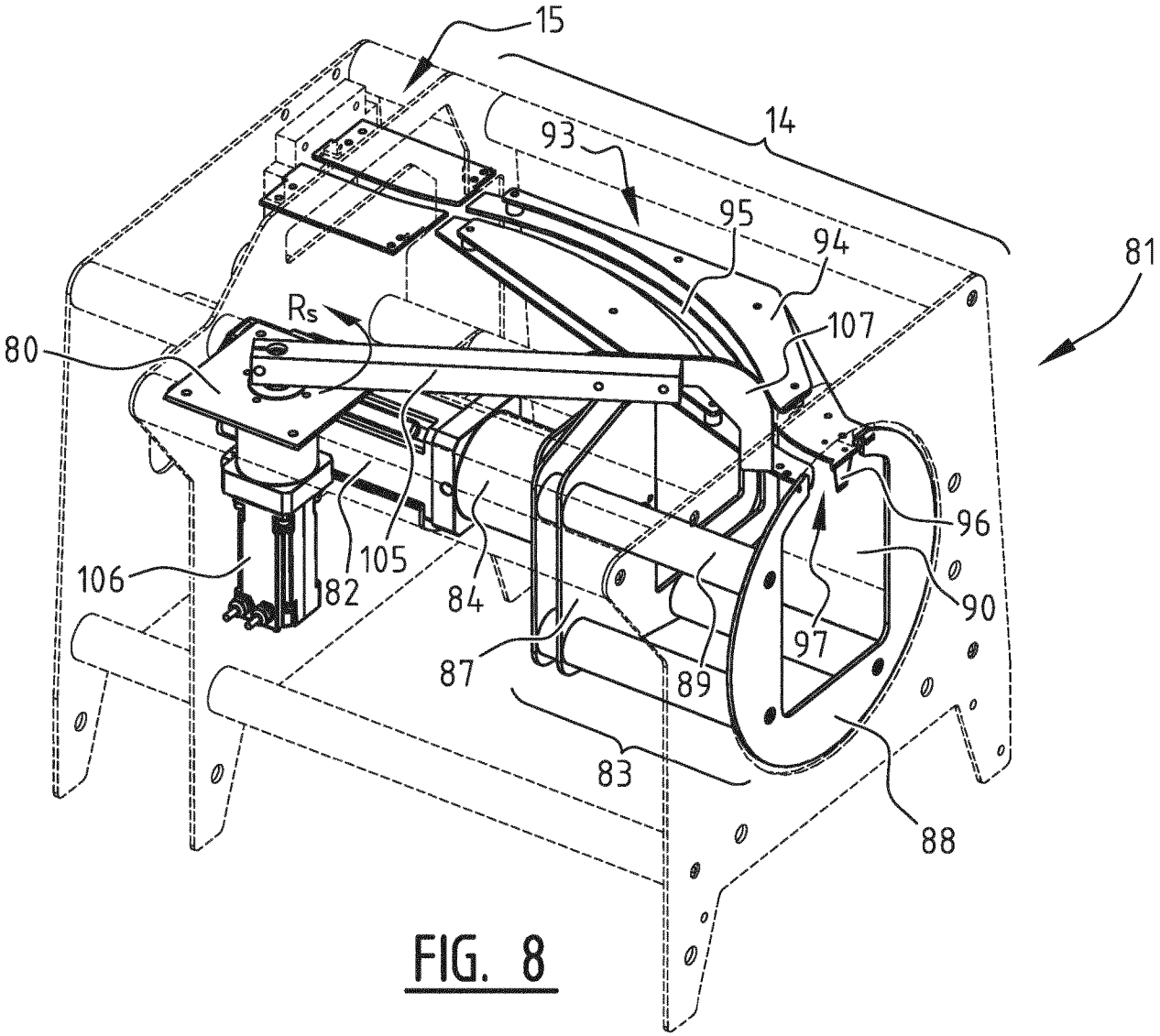
FIG. 8 is a partly cut-away view of an embodiment of a discharge device, without containers.
Figures 9, 9A:
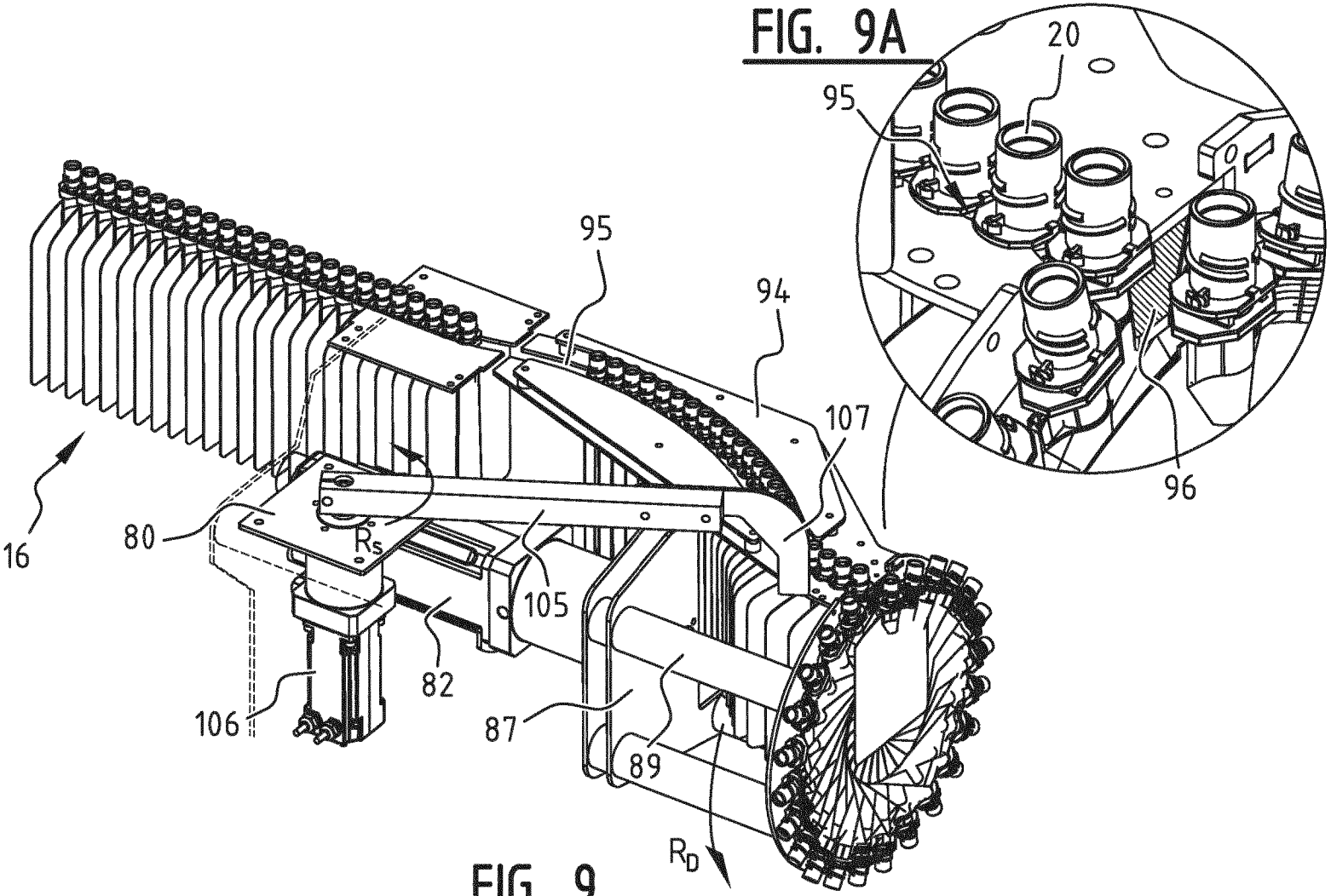
FIG. 9 is a partly cut-away view of the discharge device of FIG. 8, with containers.
FIG. 9A is a detail view of the gripper configured to grip containers from the tubular storage assembly.

In this section embodiments of the discharge device 14 will be described in more detail referring to FIGS. 8-11. FIG. 8 shows (partly in dotted lines, partly in solid lines) a stationary discharge device frame 80. In this frame 80 a rotor or gripping unit 81 comprising a rotatable gripper support 83 and a slotted gripper 93 is mounted. The rotatable gripper support 83 can be driven by an electric motor 82 which is connected to the stationary frame 80. The rotatable gripper support 83 comprises a rotatable drive shaft 84 to which is connected a construction comprising a set of parallel first support plates 87 and one or more parallel second support plates 88. The support plates 87, 88 are interconnected by four connection bars 89. The support plates 87, 88 are connected to the drive shaft 84 and can be rotated along an imaginary axis of rotation corresponding with the rotational symmetry axis 50 (FIG. 4) of the tubular storage assembly 2. Inside the second support plate 88 a central opening 90 is provided that allows passage of a container removed from the tubular storage assembly 2. This central opening 90 includes an infeed opening 97 that allows for passage of respective dispensing spouts 20 of the containers 16 when they are received by the discharge device 14.

Figure 12C:
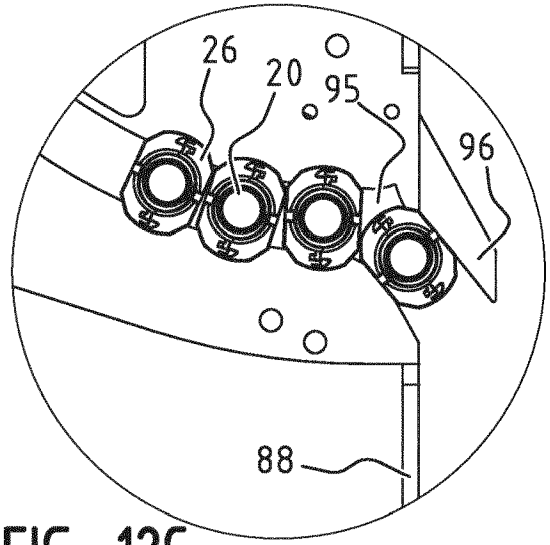
FIGS. 12A-12C are top views showing the trajectory of a number of containers during the discharge operation.
Figure 12B:
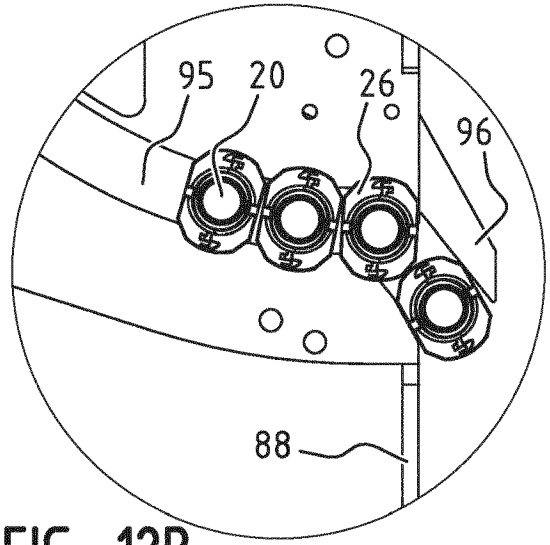
Figure 12A:
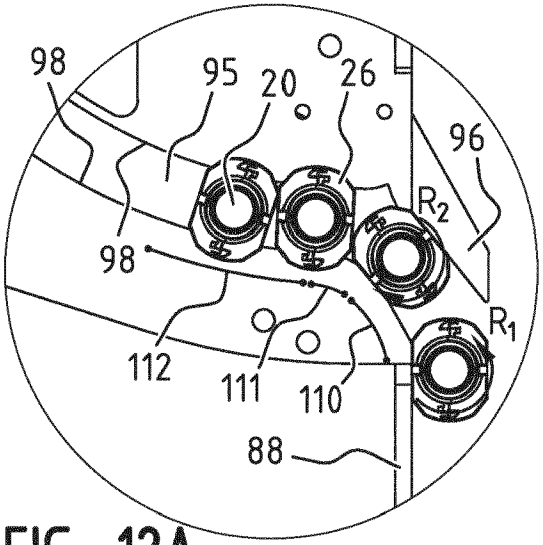

The rotatable gripper support 83 forms a support for the earlier mentioned slotted gripper 93. The slotted gripper 93 comprises one or more plates 94 extending in a general axial direction. The one or more plates 94 are provided with an elongated, curved opening or slot 95 dimensioned to carry a row of spouts 20 of discharged containers 16. A hook member 96 is mounted at the bottom side of the plates 94 and forms an extension of the slot 95 extending obliquely with respect to the remaining part of the slot 95 (cf. FIG. 12A).

FIG. 8 shows a construction for removing the containers 16 carried by the slotted gripper 93 and guiding the spouts 20 thereof in the direction of the outfeed lane 15. This construction comprises a rotatable arm 105 (herein also referred to as the sweeper arm). The rotatable arm 105 is rotatably mounted to the stationary frame 80 and can be controlled to rotate by using a drive motor 106 connected to the frame 80 as well. The arm 105 has at its free end a downward projecting arm end 107 which is shaped to allow the arm 105 to engage upon a spout 20 of a container 16 and push this container and containers downstream thereof present in the slot 95, as will be explained hereafter.

Figure 10A:
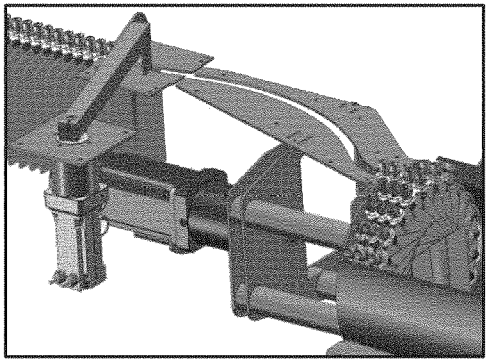
FIGS. 10A-10E are views showing an example of the discharge operation performed by a discharge device.
Figure 10B:
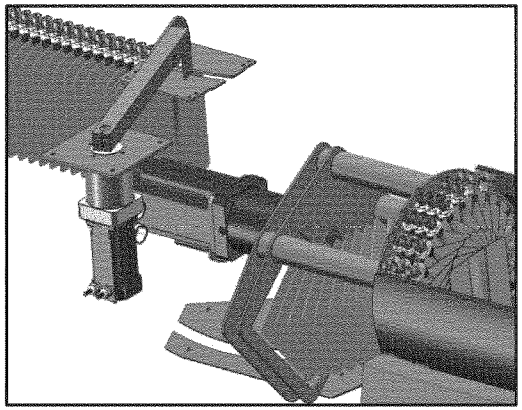
Figure 10C:
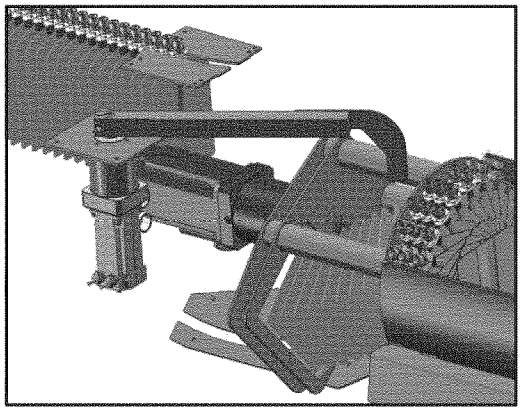
Figure 10D:
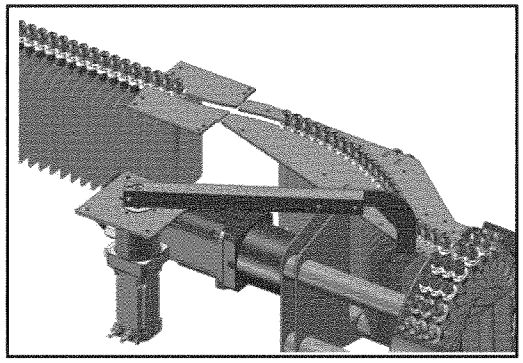
Figure 10E:
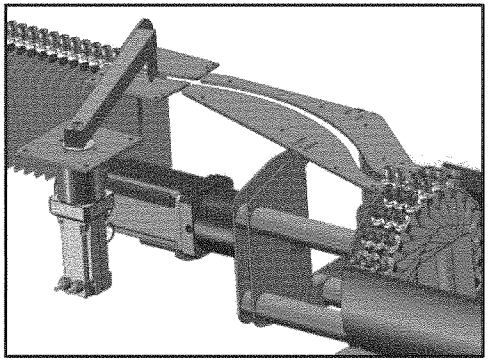
Figure 11:
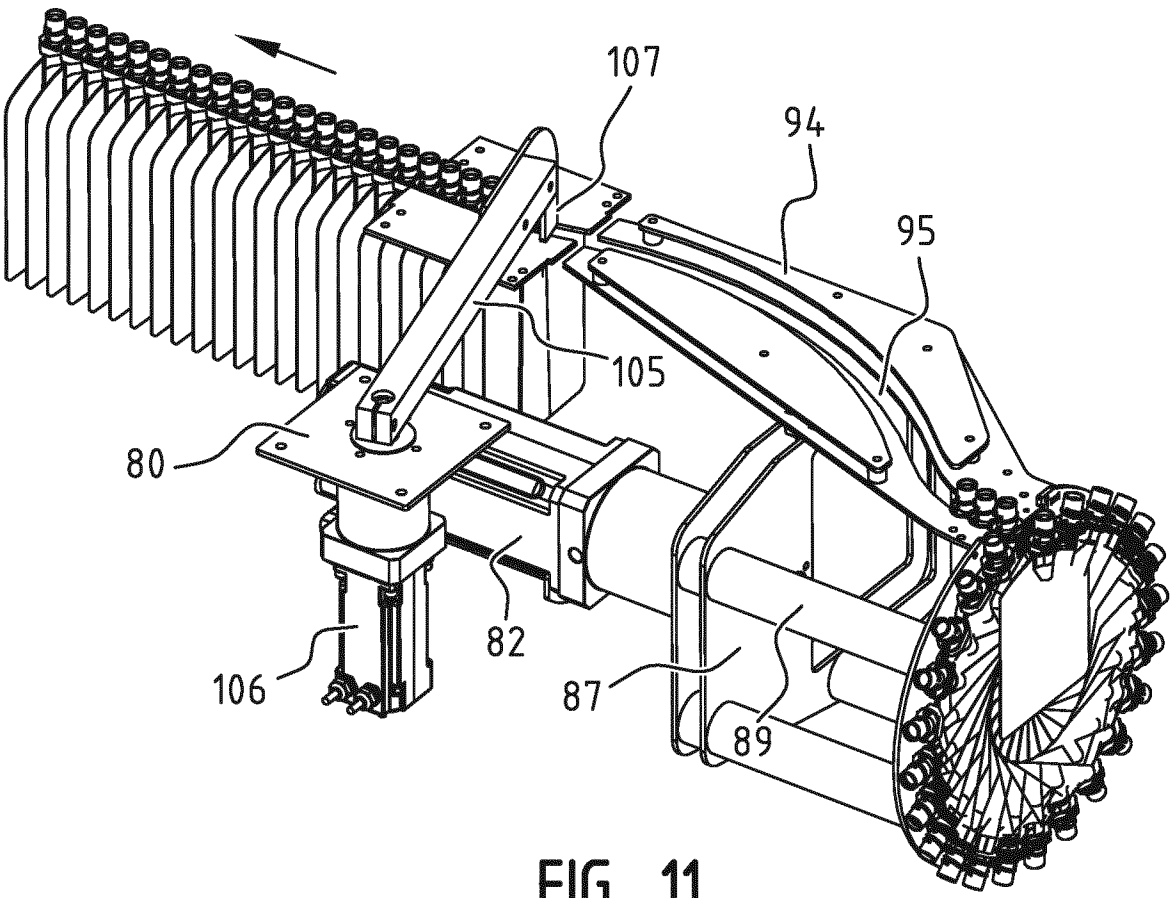
FIG. 11 is a partly cut-away view of the discharge device, after having discharged a batch of containers.

FIGS. 10A-10E show the sequence of events during the discharge of containers using the discharge device 14 described above. FIG. 10A shows the starting situation wherein the slot 95 of the slotted gripper 93 is essentially empty (although in some embodiments a few spouts of containers discharged in an earlier sequence may still be present in the infeed part of the slot 95). The rotatable gripper support 83 is rotated by the motor 82 to move relative to the stationary tubular storage assembly 2 (in direction $R_d$) in such a manner, that the infeed part of the slotted gripper 93, more specifically in this specific embodiment the infeed part formed by the hook 96, is able to engage successive dispensing spouts 20 of containers 16 as the hook 96 passes by the respective positions of the containers 16 stored in the tubular storage assembly 2. In this manner the slot 95 is filled with a container 16 every time it encounters a spout 20, resulting in a row of spouts 20 inside the slot 95 (FIG. 10B). In the meantime the sweeper arm 105 which in the situation of FIGS. 10A and 10B extends in its original position, is moved or rotated towards the infeed part of the slotted gripper 93 as is indicated in FIG. 10C. The movement of the sweeper arm 105 is accomplished during the rotation of the rotatable gripper support 83. Once the slotted gripper 93 has rotated one revolution and has reached its original position (FIG. 10D), a large part of the slot 95 of the slotted gripper 93 is filled with spouts 20. Now the rotation of the rotatable gripper support 83 is temporarily interrupted so that the sweeper arm 105 can be rotated back (rotation direction $R_s$) from its rotated position shown in FIGS. 9 and 10C to its original position (FIGS. 10E and 11). While rotating back to the original position the downward projecting arm end 107 of the sweeper arm 105 engages one of the spouts in the slot 95 and pushes the entire row of spouts in a substantially axial direction onto the outfeed lane 15 (FIG. 10E). The associated containers are suspended in the lane 15 and are ready for further handling.

In FIG. 9A and FIGS. 12A-12C, 13A-13C an example of a preferred container trajectory is depicted. FIGS. 12A-12C, 13A-13C show a detailed view of the plates 94 and the hook member 96 thereof at the infeed part of the slotted gripper 93. The slot 95 in the slotted gripper 93 has at the infeed part a proximal slot portion 110, a distal slot portion 112 and an intermediate slot portion 11. The proximal slot portion 110 has a mouth for receiving a spout 20 that is carried in a guiding element 17 of the storage assembly 2. Once the spout 20 has been received inside the proximal slot portion 110 it is caused, as a result of the specific shape of the slot portion and by the rotation of the gripper 93, to experience a forced rotation in a first rotational direction ($R_1$ FIG. 12A). This rotation has the effect that the container and especially the flexible walls thereof are loosened from the containers remaining in the tubular storage assembly 2. When the slotted gripper 93 is rotated further (direction $R_d$), the spout 20 is forced along the proximal slot portion 110 towards the intermediate slot portion 111. Once the spout 20 has reached the intermediate slot portion 111, the spout 20 is rotated, due to the shape and dimensions of the intermediate slot portion 111, in an opposite direction (direction $R_2$, see also FIGS. 13A-13B). Then the spout 20 is moved towards the distal slot portion 112 wherein the orientation of the container is kept essentially the same.

Figure 13C:
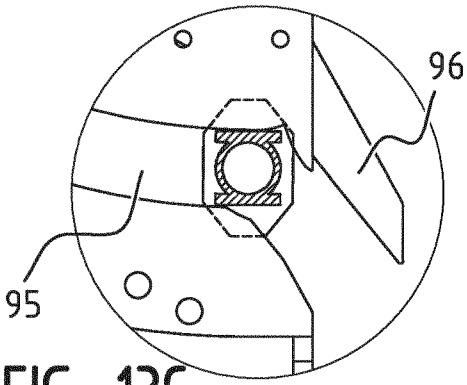
FIGS. 13A-13C are top views showing the trajectory of a certain container during a part of the discharge operation.
Figure 13B:
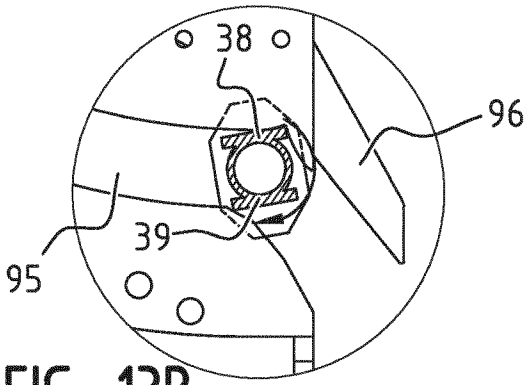
Figure 13A:
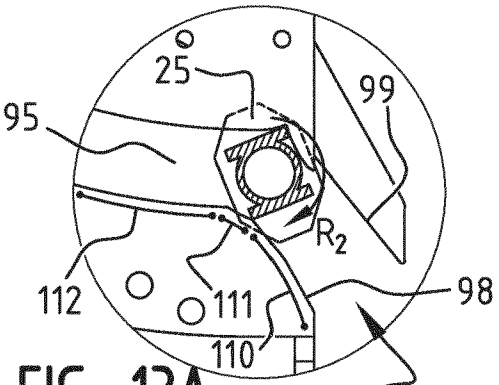

As mentioned above, the shape and dimensions of the slot 95, more specifically the proximal slot portion 110 and intermediate slot portion 111, are selected to cause the containers to undergo a controlled rotation. Referring to FIGS. 13A-13C, the orientation of a spout 20 during the movement in the intermediate slot portion 111 is shown in more detail. In these figures the upper flange part 26 (cf. FIG. 2) of the spout 20 has not been shown, only the lower flange part 25 is shown. The edges 98 of the plate 94 of the slotted gripper 93 are positioned right between the upper and lower flange parts 25, 26 of the spout. The upright walls 38, 39 of the spout 20 of the container 16 are fitted into the channel formed by slot 95 (more specifically, slot portions 110, 111, 112 of the slot 95) so that the continuous movement of the spout 20 (caused by the next spout(s) pushing against the spout 20) causes the spout 20 in the intermediate slot portion 111 to rotate in direction $R_2$ from the orientation of FIG. 13A to the rotated orientation of FIG. 13B and finally to the orientation of FIG. 13C.

As mentioned earlier, the hook 96 of the slotted gripper 93 is positioned at a slightly lower radial position than the plate 94 of the slotted gripper 93 so that the edge 99 of the hook 96 extends slightly below the lower flange part 25 of the spout 20. In this embodiment the hook 96 of the slotted gripper 93 is able to engage the spout 20 at its neck portion 100 (see FIG. 3). This is illustrated further in FIG. 9A. Clearly shown is that the hook 96 extends below the bottom surface of the horizontal section flanges 35, 36 of the guiding elements 17 so that the hook 26 made engage upon the neck 100 of the container 16. In this manner the spouts 20 of the container 16 can be easily gripped and pushed out of the channel into the guiding elements 17 and discharge towards the intermediate slot portion 111 of the slotted gripper 93.

Unfortunately, this way of gripping the container 16 and moving it outward of the storage assembly 2 is only possible in embodiments wherein the containers are shaped to have sufficient space between the lower flange part 25 and the upper edge 19 of the walls 18, 18' of the container 16. In other words, this way of gripping the container 16 at its neck portion 100 is only possible for specific types of containers 16. In other types of containers 16 wherein such neck portion 100 is not or not sufficiently available, the hook 96 cannot engage the containers 16 from a position below the guiding elements 17. For these types of containers 16 another solution is provided by using a intermediate tubular unit (cage), as well be explained hereafter.

As can be noticed from the figures the slot 95 of the slotted gripper 93 has a generally curved shape. The same applies for the shape of the plates 94 of the slotted gripper 93. The curved shape is selected to be able to rotate the slotted gripper 93 about its imaginary axis 50 without interfering with the drive shaft 84 (and the drive motor 82). In this manner the discharge device can remain compact.

Intermediate Tubular Unit

Figure 7:
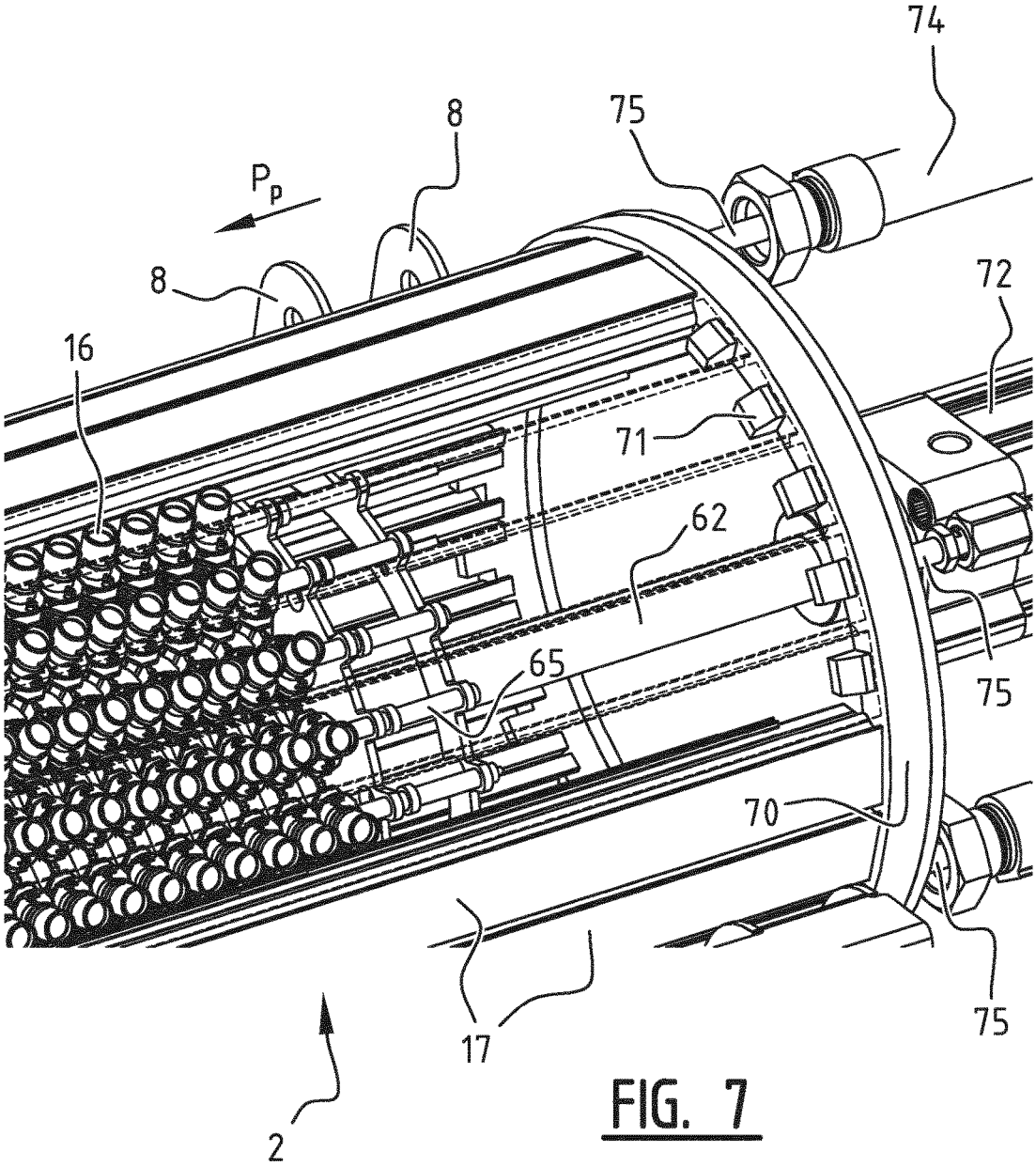
FIG. 7 is a partly cut-away view of a tubular storage assembly that is pushed by the pusher of FIG. 6.
Figure 14:
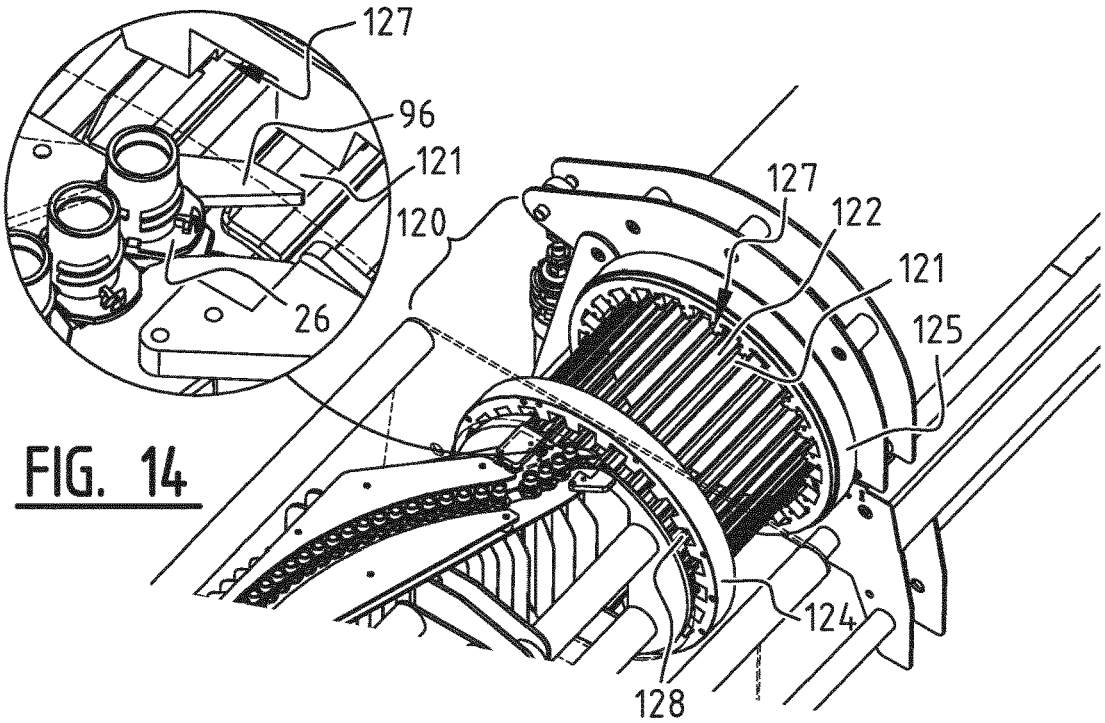
FIG. 14 is a partly cut-away top view of an embodiment of the discharge system including an intermediate tubular unit.
Figure 15:
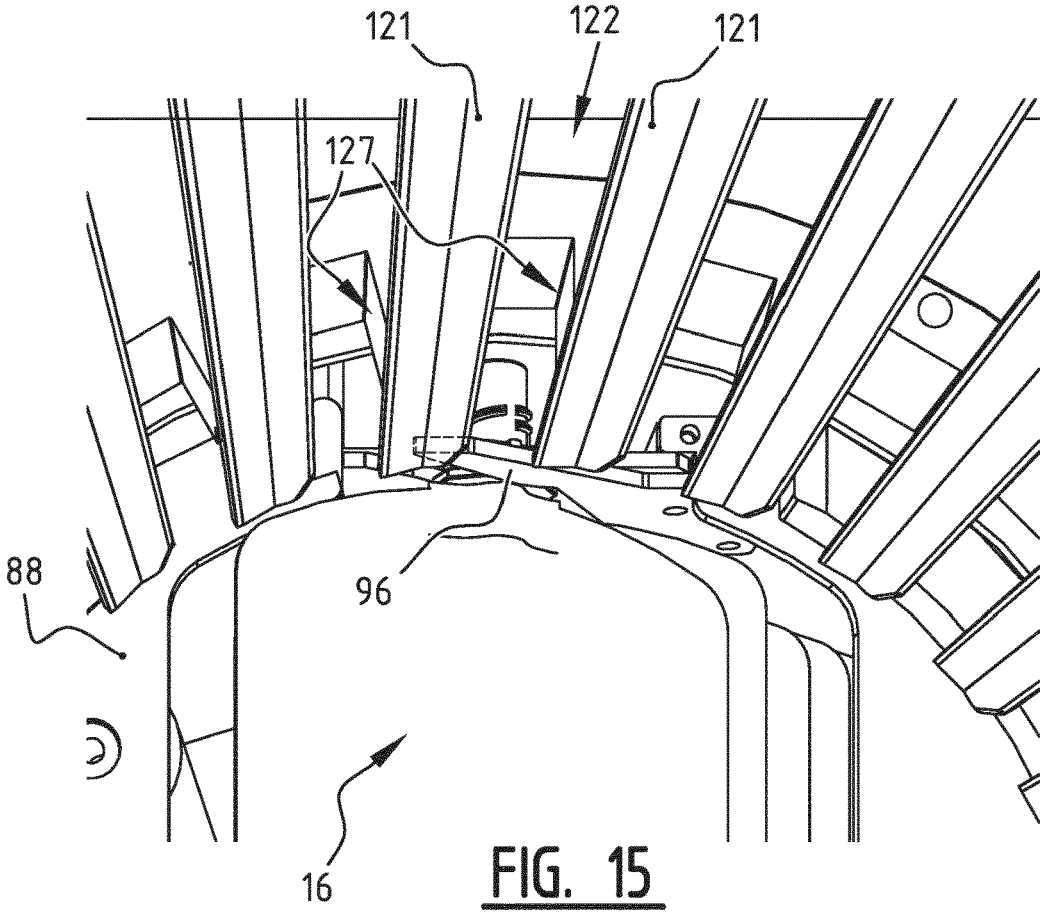
FIG. 15 is a view taken from the interior of the tubular storage device showing the hook of the gripper engaging on a container.

As shown in FIGS. 14 and 15 an intermediate tubular unit 120 can be arranged in a releasable manner between the discharge device 14 and the tubular storage assembly 2. The intermediate tubular unit 120 is connected to the tubular assembly 2 by axial projections (positioning pins) that keeps the individual guiding elements 17 in their tubular position. The tubular assembly is pushed towards the intermediate tubular unit 120 by the supporting (pusher) ring 70 (FIG. 7).

The intermediate tubular unit 120 comprises a number of parallel further elongated guided elements 121. The further guiding elements 121 define between them a number of channels 122 corresponding to the earlier mentioned channels 31 provided in the guiding elements 17 (FIG. 2). The further guiding elements 121 are aligned with the guiding elements 17 of the tubular storage assembly 2 so that they form one combined, elongated channel (combination of channels 122 and 31). Whereas the guiding element 17 have an upper section part 28 (see FIG. 2), this upper section part 28 is absent in the further guiding elements 121. The channels 122 are open at their upper side in contrast to the channels 31 in the storage assembly 2 which are closed off by the respective upper section parts 28.

As can been seen in FIGS. 14 and 15 the first ring-shaped element 124 is positioned close to (but not exactly at) the distal end of the intermediate tubular unit 120. The further guiding elements 121 slightly project in axial direction from the first ring-shaped element 124 (see sections 128, FIG. 14) so that both below the further guiding elements 121 and above the further guiding elements 121 there is sufficient space for the gripping unit 81 to grip the spouts 20 pushed through the channels 122.

This provides the opportunity for the gripping unit 81 to grip the spout 20 of a container 16 at a different portion than at the neck portion 100 referred to in the earlier described embodiments. More specifically, the gripping unit 81 may be configured to engage the spout 20 at a higher position than the upper flange part 26 of the spout 20. As mentioned earlier, this may be needed in case insufficient space for the gripper 93 is available below the lower flange part 25 of the spout 20. In still further embodiments, the gripper 93 is configured to engage the spout 20 both at an upper position above the upper flange part 26 and a lower position below the lower flange part 25 in order to push the spout 20 at two positions towards the discharge device 14.

In order for the further guiding elements 121 to be maintained in the substantial tubular arrangement, a bridge is provided. The bridge comprises a first ring-shaped element 124 and a second ring-shaped element 125 positioned parallel and at a certain distance of the first ring-shaped element 124. The ring-shaped elements 124, 125 have protrusions 127 connected to the upper surface of the further guiding elements 121 in order to keep the further guiding elements 121 in place. The guiding elements 121 are made of a stiff (substantially non-flexible) material so that the further guiding elements 121 together with the bridge form a relatively stiff construction.

In a further embodiment the intermediate tubular unit 120 can be removed easily. After a suitable relative positioning of the discharge device 14 and the assembly 2 (and possibly after having replaced the hook 96) the discharge system 1 is ready for handling the containers 20 of the type that has a sufficiently large neck portion 100 to allow gripping of the spouts 20 directly from the tubular storage assembly 2.

Figure 16:
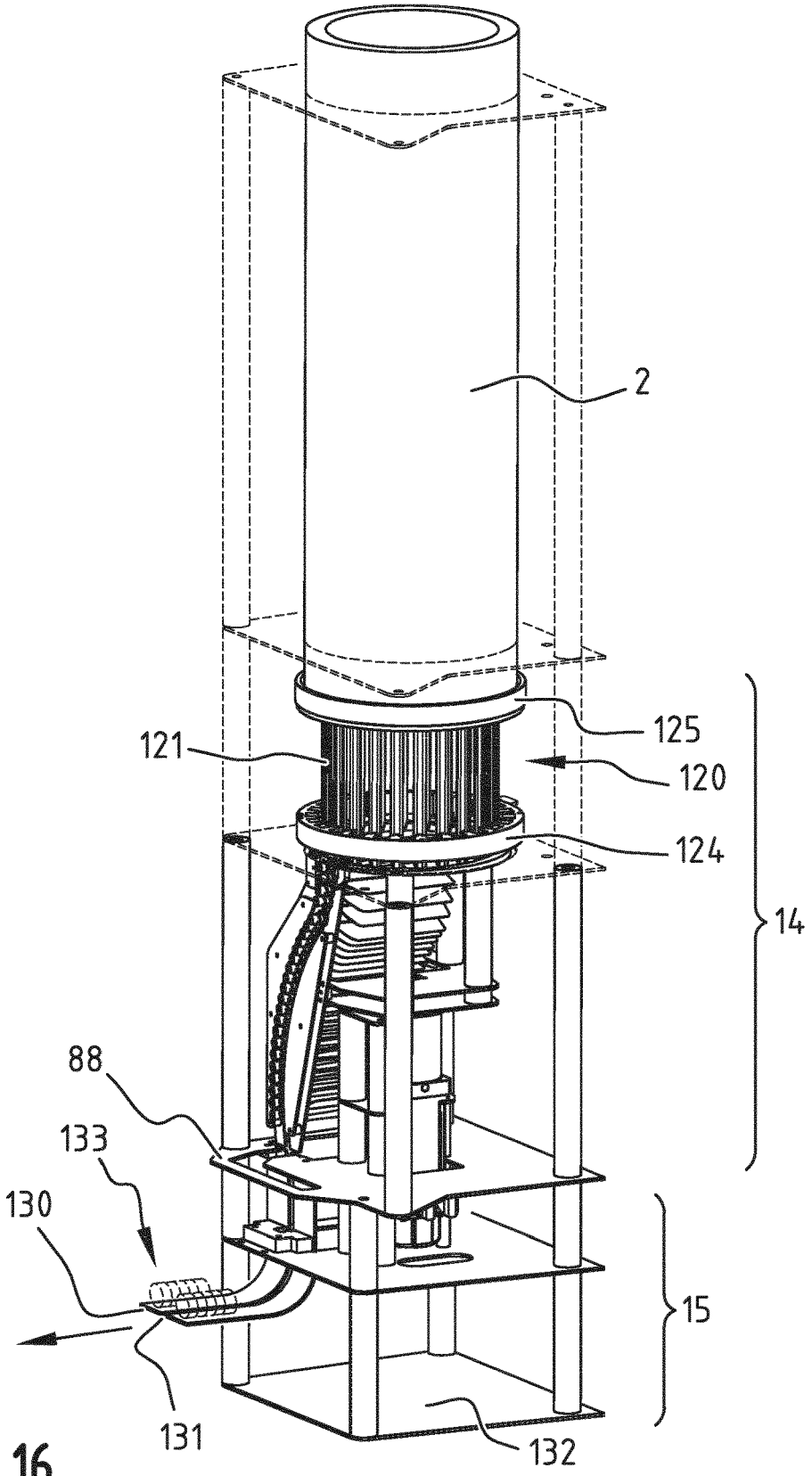
FIG. 16 is a view of a further embodiment of the discharge system.

In FIG. 16 a further embodiment of the present invention is shown. This embodiment corresponds to the embodiments described earlier with the exception that the storage assembly support 12 is configured to support the tubular storage assembly 2 in a substantially vertical position and in that the discharge device 14 is supported on a support plate 132. In the shown embodiment the earlier mentioned intermediate tubular unit 120 is employed, although is other embodiments this intermediate tubular element 120 can be dispensed with if the type of container 16 allows gripping at the lower part of the spout 20. In the latter embodiments the vertical tubular storage assembly 2 is connected directly to the discharge device 14. Furthermore, although the storage assembly support 12 and the discharge device 14 have been depicted in a vertical position, the storage assembly support 12 may also be configured to support the tubular storage assembly 2 in an oblique position, for instance at an angle between 1 and 50 degrees relative to the vertical direction.

FIG. 16 also shows that the discharge device 14 is provided with an alternative output device 133. The output device 133 is configured to receive the containers 20 moved downwards along the (further) guiding elements 121 and the slotted gripper 93 and transmit the received containers 20 to a further conveyor. The output device 133 may comprise a curved plate 130 having a slot 131 connected to the slot 95 of the slotted gripper 93 for guiding the containers 20 towards the conveyor (not shown). In embodiments of the gripping unit 81 the friction between the slot 95 and the spouts 20 caused by the weight of respective containers 16 may word to prevent the containers 16 from falling out of the slot 95. In other embodiment an additional stop mechanism is provided to keep the spouts 20 inside the slot 95 until the row of spouts 20 can be discharged.

In these embodiments the containers 16 are forced to move downwards with the discharged region by the influence of gravity. In some cases a separate pusher can be dispensed with, while in other cases a pusher 13 is still present (but can have a more simple construction, for instance without the actuators 74 for maintaining the guiding elements 17 in place).

In order to further assist the containers 16 to move in downward direction, an optional vibration unit can be mounted to the support. This vibration unit causes the loaded storage assembly 2 to vibrate as a whole and for at least a minimum period necessary to be able to assist the containers 16 to move downwards along the (further) guiding elements 121 and the slotted gripper 93.

The preceding merely illustrates the principles of the invention. It will be appreciated that those skilled in the art will be able to devise various arrangements which, although not explicitly described or shown herein, embody the principles of the invention and are included within the scope of the appended claims.

The invention claimed is:

1. A discharge system for discharging a plurality of flexible containers from a tubular storage assembly, wherein each of the containers comprises a dispensing spout and wherein the storage assembly comprises a plurality of elongated guiding elements onto which a plurality of rows of dispensing spouts can be carried, wherein the guiding elements are configured to be maintained in a substantially tubular arrangement while the containers extend in a generally helical trajectory in the interior formed by the tubular arrangement, the discharge system comprising:

a storage assembly support configured to support the tubular storage assembly, the guiding elements extending in axial direction;

a discharge device configured to remove the containers from the tubular storage assembly and move the containers one by one from the second end of the tubular storage assembly towards a discharge region, wherein the discharge device comprises:

a gripper unit;

a drive configured to cause the storage assembly and the gripper unit to rotate relative to each other;

wherein the gripper unit is configured to grip dispensing spouts of containers successively passing by the gripper unit, to transport the gripped dispensing spouts and associated containers in essentially the axial direction and to collect the dispensing spouts in the discharge region.

2. The discharge system as claimed in claim 1, wherein the storage assembly support is configured to support the tubular storage assembly in a stationary position, wherein the drive is configured to rotate the gripper unit relative to the tubular storage assembly.

3. The discharge system as claimed in claim 1, wherein the gripper unit comprises:

a rotatable gripper support configured to rotate about an axis of rotation parallel to or coinciding with the axis of symmetry of the tubular storage assembly;

a slotted gripper configured to engage successive dispensing spouts of containers when the slotted grippers is rotated to pass by the containers carried by successive guiding elements and to guide the engaged dispensing spouts one by one through the slot provided therein towards the discharge region, preferably comprising a hook member configured to guide the spouts of the containers in the slot of the slotted gripper.

4. The discharge system as claimed in claim 1, comprising a pusher configured to engage one or more containers arranged at a first end of the tubular storage assembly and configured to push the containers arranged in the tubular storage assembly in axial direction towards a second end, opposite the first end wherein the pusher is preferably further configured to engage the first end of the tubular storage assembly so as to position the second end of the tubular storage assembly relative to the gripper unit, wherein the pusher preferably comprises a support ring having axial projections configured to be coupled to the individual guiding elements so as to position the guiding elements relative to each other, wherein the pusher is preferably configured to bias the dispensing spouts of the containers at the second end of the tubular storage assembly against the gripper unit, wherein the pusher preferably comprises a pusher element configured to engage the containers at axially staggered positions along a helical trajectory, wherein the pusher is configured to engage the one or more containers at their respective dispensing spouts.

5. The discharge system as claimed in claim 1, comprising a gripper unit configured so as to face an open end of the tubular storage assembly, wherein the gripper unit comprises a gripper configured to grip the dispensing spouts directly from the guiding elements of the tubular storage assembly.

6. The discharge system as claimed in claim 1, comprising an intermediate tubular unit configured to be placed between the gripper unit and an open end of the tubular storage assembly, wherein the intermediate tubular unit comprises a plurality of further elongated guiding elements onto which a plurality of rows of dispensing spouts can be carried, wherein the further guiding elements are configured to be maintained in a substantially tubular arrangement corresponding to the guiding elements of the tubular storage assembly wherein the intermediate tubular unit is preferably shaped so that the gripper unit can grip a dispensing spout at a radially outer position relative to the tubular arrangement of further guiding elements, preferably also at a radially inner position, wherein the further elongated guiding elements are preferably connected to one or more support rings, the support rings being configured to maintain the further guiding element in a tubular arrangement while providing the gripping unit access to an upper portion of a container arranged in a guiding element of the tubular storage assembly, is preferably configured to be releasably connected to the tubular storage assembly.

7. The discharge system as claimed in claim 6, comprising a slotted gripper configured to engage successive dispensing spouts of containers, wherein the slot of the slotted gripper is shaped so as to control rotation of the dispensing spout and associated container relative to the gripper, wherein the slot is preferably shaped so as to force rotation of the dispensing spout and associated container in a first rotational direction to arrange the container from a first position extending essentially perpendicular to the axial direction to a second position extending obliquely relative to the axial direction and subsequently force the dispensing spout and associated container to rotate in a second direction, opposite the first direction, wherein the slot of the slotted gripper preferably comprises:

a proximal slot portion extending obliquely relative to the axial direction of the tubular storage assembly causing the dispensing to rotate in the first rotational direction;

an intermediate slot portion comprising an edge part configured to rotate the dispensing spout in opposite rotational direction;

a distal slot portion for accumulating a plurality of dispensing spouts and guiding the dispensing spouts towards the discharge region.

8. The discharge system as claimed in claim 1, wherein the discharge device comprises a rotatable sweeper arm and a sweeper arm drive configured to sweep the collected dispensing spouts out of the gripper unit.

9. The discharge system as claimed in claim 1, comprising a drive configured to rotate the gripper unit relative to the tubular storage assembly, the drive comprising a drive shaft connected to the rotatable gripper support and the drive shaft being arranged essentially coaxially with the tubular storage assembly, wherein gripper unit preferably comprises gripper having an essentially curved shape so as to allow the gripper to be rotated in a trajectory around the drive shaft.

10. The discharge system as claimed in claim 1, wherein the storage assembly support comprises one or more positioning arms configured to be moved between an open position wherein the tubular storage assembly can be removed or loaded and a closed position wherein the positioning arms form an essentially annular gripping space, wherein the diameter of the gripping space is smaller than the outer diameter of the tubular storage assembly.

11. The discharge system as claimed in claim 1, comprising a vibration section configured to vibrate the tubular storage assembly when the tubular storage assembly is on the tubular storage assembly support.

12. The discharge system as claimed in claim 1, wherein the storage assembly support is configured to support the tubular storage assembly in a substantially upright position so as to cause the containers to move due to the gravitational force in an axial, downward direction towards the discharge device.

* * * * *